US012618304B2

(12) United States Patent
Martin et al.

(10) Patent No.: US 12,618,304 B2
(45) Date of Patent: May 5, 2026

(54) DOWNHOLE ISOLATION TOOL INCLUDING AN ISOLATION SLEEVE AND SACRIFICIAL PLUG MEMBER

(71) Applicant: Halliburton Energy Services, Inc., Houston, TX (US)

(72) Inventors: Walker Martin, Carrollton, TX (US); Matthew James Kelsey, Spring, TX (US); David Joe Steele, Carrolton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/649,651

(22) Filed: Apr. 29, 2024

(65) Prior Publication Data

US 2025/0334024 A1 Oct. 30, 2025

(51) Int. Cl.

| | |
|---|---|
| ***E21B 34/14*** | (2006.01) |
| ***E21B 23/00*** | (2006.01) |
| ***E21B 33/12*** | (2006.01) |

(52) U.S. Cl.

CPC ..... *E21B 34/14* (2013.01); *E21B 23/006* (2013.01); *E21B 33/1208* (2013.01); *E21B 2200/06* (2020.05)

(58) Field of Classification Search

CPC .... E21B 34/14; E21B 23/006; E21B 33/1208; E21B 2200/06

See application file for complete search history.

(56) References Cited

U.S. PATENT DOCUMENTS 3,882,935 A * 5/1975 Calhoun ..... E21B 34/106 166/322
4,403,659 A * 9/1983 Upchurch ..... E21B 23/006 166/321

(Continued)

FOREIGN PATENT DOCUMENTS

WO 2011072367 A1 6/2011
WO 2020231268 A1 11/2020

OTHER PUBLICATIONS

Thapa, P., "Design and Calculation of the Pressure Relief Valves and Rupture Disks System," Centre for Risk, Integrity and Safety Engineering, 54 pages, Dec. 2016, Research Gate.

*Primary Examiner* — Steven A Macdonald
(74) *Attorney, Agent, or Firm* — Scott Richardson; Parker Justiss, P.C.

(57) ABSTRACT

Provided is a downhole isolation tool, a well system, and a method. The downhole isolation tool, in one aspect, includes an outer housing, the outer housing having a fluid passageway extending along a length thereof, an outer housing exterior surface, and an outer housing interior surface, as well as one or more fluid flow ports connecting the fluid passageway and the outer housing exterior surface. The downhole isolation tool, in one aspect, further includes an isolation sleeve positioned within the fluid passageway, the isolation sleeve configured to shift between an open state and a closed state covering the one or more fluid flow ports and obstructing fluid flow between the fluid passageway and the outer housing exterior surface, as well as a sacrificial plug member fluidly coupled with the fluid passageway, the sacrificial plug member configured to seal fluid flow through the fluid passageway.

54 Claims, 27 Drawing Sheets

(56) References Cited

U.S. PATENT DOCUMENTS 4,537,258 A * 8/1985 Beck ..... E21B 49/001 166/374
5,775,428 A * 7/1998 Davis ..... E21B 34/142 166/117.6
5,947,204 A 9/1999 Barton
6,298,919 B1 * 10/2001 Browne ..... E21B 21/10 166/373
8,267,178 B1 * 9/2012 Sommers ..... E21B 34/103 166/334.4
9,752,406 B2 9/2017 Hardesty et al.
10,030,473 B2 7/2018 Tolman et al.
10,107,070 B2 10/2018 Yong et al.
10,273,780 B2 4/2019 Garcia et al.
10,787,884 B2 * 9/2020 Brandsdal ..... E21B 34/10
11,149,522 B2 * 10/2021 Brandsdal ..... E21B 34/063
11,332,999 B1 * 5/2022 Eriksen ..... E21B 33/1208
11,441,382 B1 * 9/2022 Eriksen ..... E21B 34/102
11,639,641 B2 * 5/2023 Stratton ..... E21B 29/00 166/376
11,719,069 B2 8/2023 Hiorth et al.
12,134,945 B2 * 11/2024 Decuir ..... E21B 34/063
2003/0183392 A1 * 10/2003 Garay ..... E21B 34/10 166/334.1
2004/0069496 A1 4/2004 Hosie et al.
2005/0263279 A1 * 12/2005 Vachon ..... E21B 34/10 166/334.1
2009/0056952 A1 * 3/2009 Churchill ..... E21B 21/10 166/373
2010/0270031 A1 * 10/2010 Patel ..... E21B 33/1208 166/376
2011/0011597 A1 * 1/2011 Fay ..... F16K 3/26 166/321
2011/0315389 A1 * 12/2011 Crider ..... E21B 21/103 166/329
2012/0006553 A1 * 1/2012 Korkmaz ..... E21B 34/142 166/332.8
2012/0261136 A1 * 10/2012 Ehtesham ..... E21B 34/14 166/334.1
2013/0056220 A1 * 3/2013 Sommers ..... E21B 34/102 166/334.1
2014/0008085 A1 * 1/2014 Tinnen ..... E21B 33/134 166/134
2014/0102703 A1 * 4/2014 Mailand ..... E21B 34/10 166/279
2015/0075809 A1 3/2015 Getzlaf et al.
2016/0060998 A1 * 3/2016 Hiorth ..... E21B 33/1208 166/192
2016/0194933 A1 7/2016 O'Brien et al.
2016/0230505 A1 8/2016 Garcia et al.
2016/0333655 A1 * 11/2016 Fripp ..... E21B 29/02
2018/0313183 A1 * 11/2018 Hiorth ..... E21B 33/134
2019/0017345 A1 * 1/2019 Brandsdal ..... E21B 33/1208
2019/0032448 A1 * 1/2019 Bjørgum ..... E21B 34/063
2019/0032449 A1 1/2019 Ring
2019/0284902 A1 * 9/2019 Nudo ..... E21B 34/14
2020/0131884 A1 * 4/2020 Saraya ..... E21B 34/06
2020/0157917 A1 * 5/2020 Olguin ..... E21B 23/006
2021/0017833 A1 * 1/2021 Saraya ..... E21B 33/1208
2021/0040816 A1 * 2/2021 Hiorth ..... E21B 34/063
2021/0047895 A1 * 2/2021 Sherman ..... E21B 29/02
2021/0108476 A1 * 4/2021 Brandsdal ..... E21B 33/1208
2021/0332667 A1 * 10/2021 Dharne ..... E21B 33/1294
2022/0290546 A1 * 9/2022 Campbell ..... E21B 43/025

* cited by examiner

DOWNHOLE ISOLATION TOOL INCLUDING AN ISOLATION SLEEVE AND SACRIFICIAL PLUG MEMBER

BACKGROUND

The unconventional market is extremely competitive. The market is trending towards longer horizontal wells to increase reservoir contact. Multilateral wells offer an alternative approach to maximize reservoir contact. Multilateral wells include one or more lateral wellbores extending from a main wellbore. A lateral wellbore is a wellbore that is diverted from the main wellbore or another lateral wellbore.

The lateral wellbores are typically formed by positioning one or more deflector assemblies at desired locations in the main wellbore (e.g., an open hole section or cased hole section) with a running tool. The deflector assemblies are often laterally and rotationally fixed within the main wellbore using a wellbore anchor, and then used to create an opening in the casing, wherein thereafter the later wellbore may be drilled to depth.

BRIEF DESCRIPTION

Reference is now made to the following descriptions taken in conjunction with the accompanying drawings, in which.

DETAILED DESCRIPTION

Figure 1:
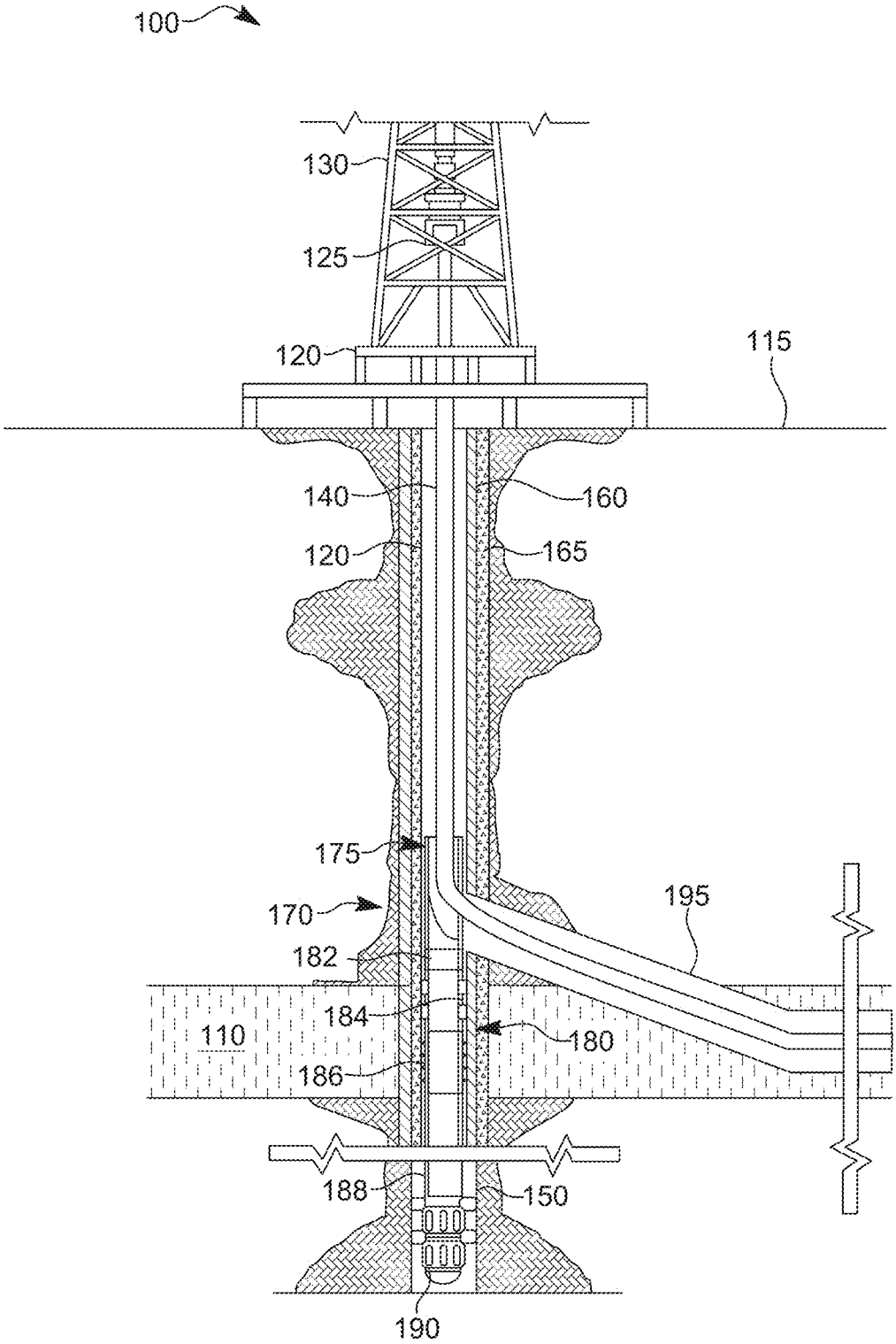
FIG. 1 illustrates a schematic view of a well system designed, manufactured and operated according to one or more embodiments disclosed herein.

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms.

Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to a direct interaction between the elements, and may also include an indirect interaction between the elements described. Unless otherwise specified, use of the terms "up," "upper," "upward," "uphole," "upstream," or other like terms shall be construed as generally away from the bottom, terminal end of a well; likewise, use of the terms "down," "lower," "downward," "downhole," "downstream," or other like terms shall be construed as generally toward the bottom, terminal end of a well, regardless of the wellbore orientation. Use of any one or more of the foregoing terms shall not be construed as denoting positions along a perfectly vertical axis. Unless otherwise specified, use of the term "subterranean formation" shall be construed as encompassing both areas below exposed earth and areas below earth covered by water, such as ocean or fresh water.

The present disclosure is based, at least in part, on a recognition that current downhole isolation tools have a difficulty and/or inability to allow for fluid flow circulation around the downhole isolation tool prior to setting the anchoring/sealing subassembly located there above. The present disclosure has further recognized that current downhole isolation tools have a difficulty and/or inability to close and isolate one or more fluid flow circulation ports of the downhole isolation tool after the anchoring/sealing subassembly located there above has been set. Accordingly, the present disclosure has developed an improved downhole isolation tool that allows for fluid flow circulation around the downhole isolation tool as it is being run-in-hole (e.g., using one or more fluid flow ports connecting a fluid passageway and exterior surface of the downhole isolation tool), but allows for closing (e.g., hydraulically closing) the one or more fluid flow ports using an isolation sleeve after the anchoring/sealing subassembly has been set. The improved downhole isolation tool additionally includes a sacrificial plug member that prevents fluid flow through the fluid passageway as the downhole isolation tool is being run-in-hole (e.g., forcing the fluid flow circulation around the downhole isolation tool via the one or more fluid flow ports), but the sacrificial plug member is configured to be ruptured at a point in time after setting the anchoring/sealing subassembly (e.g., after closing the one or more fluid flow ports using the isolation sleeve) to reestablish fluid flow through the downhole isolation tool.

For example, in at least one embodiment, the downhole isolation tool is configured to be run on the end of a lower completion (e.g., lower completion string including one or more screens, one or more interval control valves (ICVs), one or more packers, a liner string, etc.). While the downhole isolation tool is being run-in-hole, the downhole isolation tool will allow annular access above and around the sacrificial plug member (e.g., via the one or more fluid flow ports and sliding sleeve in the open state) to prevent scrubbing and allow for circulation. Thereafter (e.g., under a targeted and controlled fluid flow rate), the isolation sleeve of the downhole isolation tool will shift to move from the open state (e.g., allowing circulation) to a closed state (e.g., closing off circulation), restricting any annular access, and gaining an ability to create a pressure differential above and below the sacrificial plug member. Thereafter, the sacrificial plug member may be pressured up against, and in doing so the anchoring/sealing subassembly can be set. With the anchoring/sealing subassembly set, the sacrificial plug member may be ruptured via a conveyance (e.g., a rupturing conveyance extending from a surface of the wellbore, such as a bar run on a wireline, or an internal sacrificial plug rupture device (e.g., interventionless rupture)), and thereby return fluid flow access through the fluid passageway and below the downhole isolation tool. Accordingly, the improved downhole isolation tool enables a user to deploy a sacrificial plug member on the same trip as the anchoring/sealing subassembly, and in doing so allows for the elimination of a ball pressure system to set anchoring/sealing subassembly, as the user is isolating the main wellbore prior to milling a lateral window and drilling the lateral wellbore to depth.

FIG. 1 is a schematic view of a well system 100 designed, manufactured and/or operated according to one or more embodiments disclosed herein. The well system 100 includes a platform 120 positioned over a subterranean formation 110 located below the earth's surface 115. The platform 120, in at least one embodiment, has a hoisting apparatus 125 and a derrick 130 for raising and lowering one or more downhole tools including pipe strings, such as a drill string 140 (e.g., a conveyance). Although a land-based oil and gas platform 120 is illustrated in FIG. 1, the scope of this disclosure is not thereby limited, and thus could potentially apply to offshore applications. The teachings of this disclosure may also be applied to other land-based or offshore-based well systems different from that illustrated.

As shown, a main wellbore 150 has been drilled through the various earth strata, including the subterranean formation 110. The term "main" wellbore is used herein to designate a wellbore from which another wellbore is drilled. It is to be noted, however, that a main wellbore 150 does not necessarily extend directly to the earth's surface 115, but could instead be a branch of yet another wellbore. A casing string 160 may be at least partially cemented within the main wellbore 150, for example using cement 165. The term "casing" is used herein to designate a tubular string used to line a wellbore. Casing may actually be of the type known to those skilled in the art as a "liner" and may be made of any material, such as steel or composite material and may be segmented or continuous, such as coiled tubing. The term "lateral" wellbore is used herein to designate a wellbore that is drilled outwardly from its intersection with another wellbore, such as a main wellbore. Moreover, a lateral wellbore may have another lateral wellbore drilled outwardly therefrom.

In the embodiment of FIG. 1, a whipstock assembly 170 according to one or more embodiments of the present disclosure is positioned at a location in the main wellbore 150. Specifically, the whipstock assembly 170 could be placed at a location in the main wellbore 150 where it is desirable for a lateral wellbore 195 to exit. Accordingly, the whipstock assembly 170 may be used to support a milling tool used to penetrate a window in the main wellbore 150, and once the window has been milled and a lateral wellbore 195 formed, in some embodiments, the whipstock assembly 170 may be retrieved and returned uphole by a retrieval tool.

The whipstock assembly 170, in at least one embodiment, includes a whipstock element section 175, as well as an anchoring/sealing subassembly 180 coupled to a downhole end thereof. The anchoring/sealing subassembly 180, in one or more embodiments, includes an orienting receptacle section 182, a sealing section 184, and a latching element section 186. In at least one embodiment, the latching element section 186 axially, and optionally rotationally, fixes the whipstock assembly 170 within the casing string 160. The sealing section 184, in at least one embodiment, seals (e.g., provides a pressure tight seal to) an annulus between the whipstock assembly 170 and the casing string 160. The orienting receptacle section 182, in one or more embodiments, along with a collet and one or more orienting keys, may be used to land and positioned a guided milling assembly and/or the whipstock element section 175 within the casing string 160.

In the illustrated embodiment of FIG. 1, the well system further includes a lower completion 188 and downhole isolation tool 190 designed, manufactured and/or operated according to one or more embodiments of the disclosure. The term "lower completion," as used herein, includes a string having one or more of the following features, among others: sealbore extensions, liners, screens, isolation devices (e.g., expandable, swellable, etc.), inflow control devices, etc. In the illustrated embodiment, the downhole isolation tool 190 is coupled to a downhole end of the lower completion 188. Further to the illustrated embodiment, the lower completion 188 is coupled to a downhole end of the whipstock assembly 170, for example via the anchoring/sealing subassembly 180.

The elements of the whipstock assembly 170, lower completion 188, and downhole isolation tool 190 may be positioned within the main wellbore 150 in one or more separate steps. Nevertheless, in at least one embodiment, the anchoring/sealing sub assembly 180, including the orienting receptacle section 182, sealing section 184 and the latching element section 186, along with the lower completion 188 and downhole isolation tool 190, are run in hole first, and then set within the casing string 160. Thereafter, the sealing section 184 may be pressure tested. Thereafter, the whipstock element section 175 may be run in hole and coupled to the anchoring/sealing subassembly 180, for example using the orienting receptacle section 182. What may result is the whipstock assembly 170, lower completion 188, and downhole isolation tool 190 illustrated in FIG. 1.

Figure 2A:
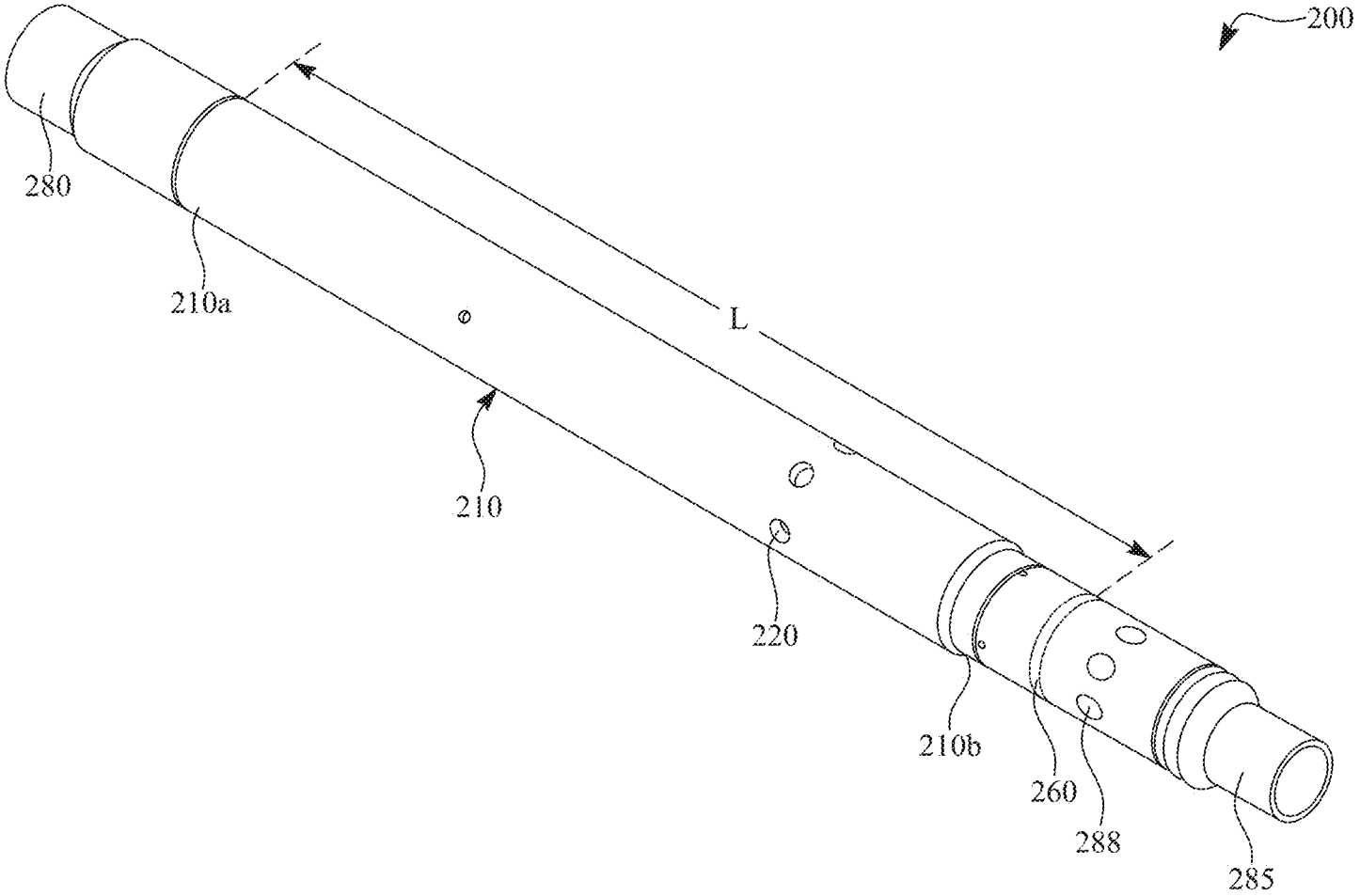
FIGS. 2A through 2K illustrate a downhole isolation tool designed, manufactured and/or operated according to one or more embodiments of the disclosure.
Figure 2B:
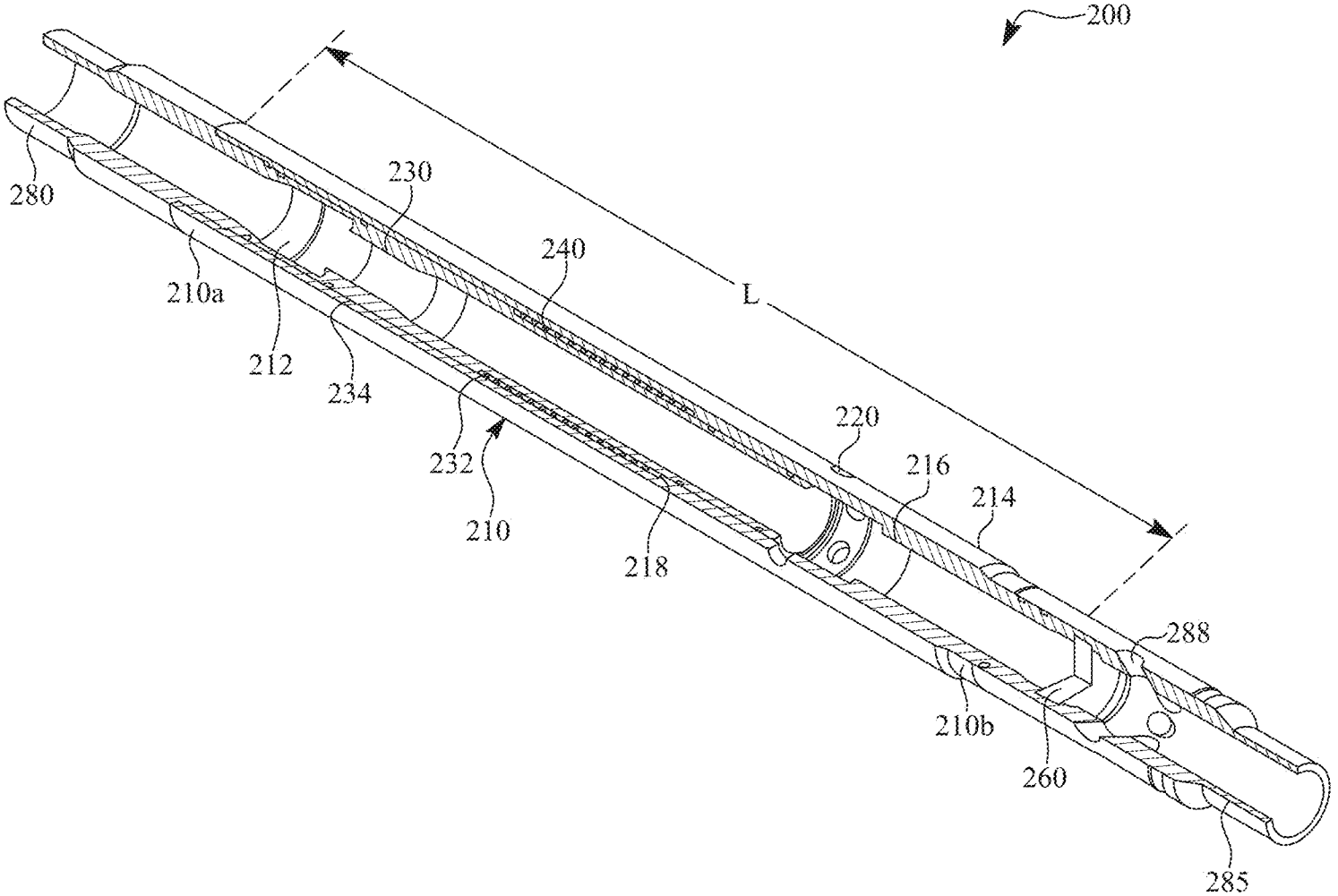
Figure 2C:
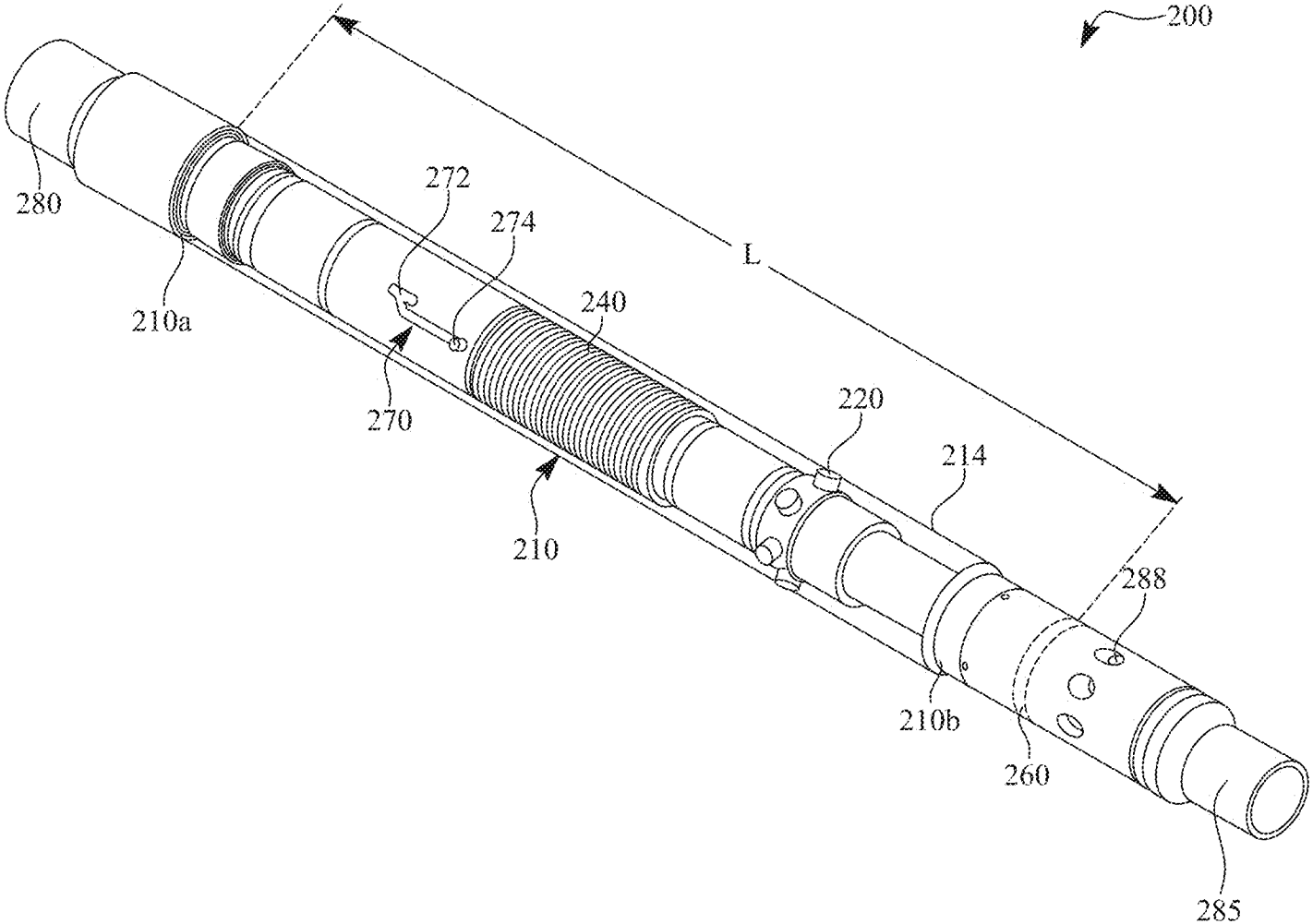
Figure 2D:
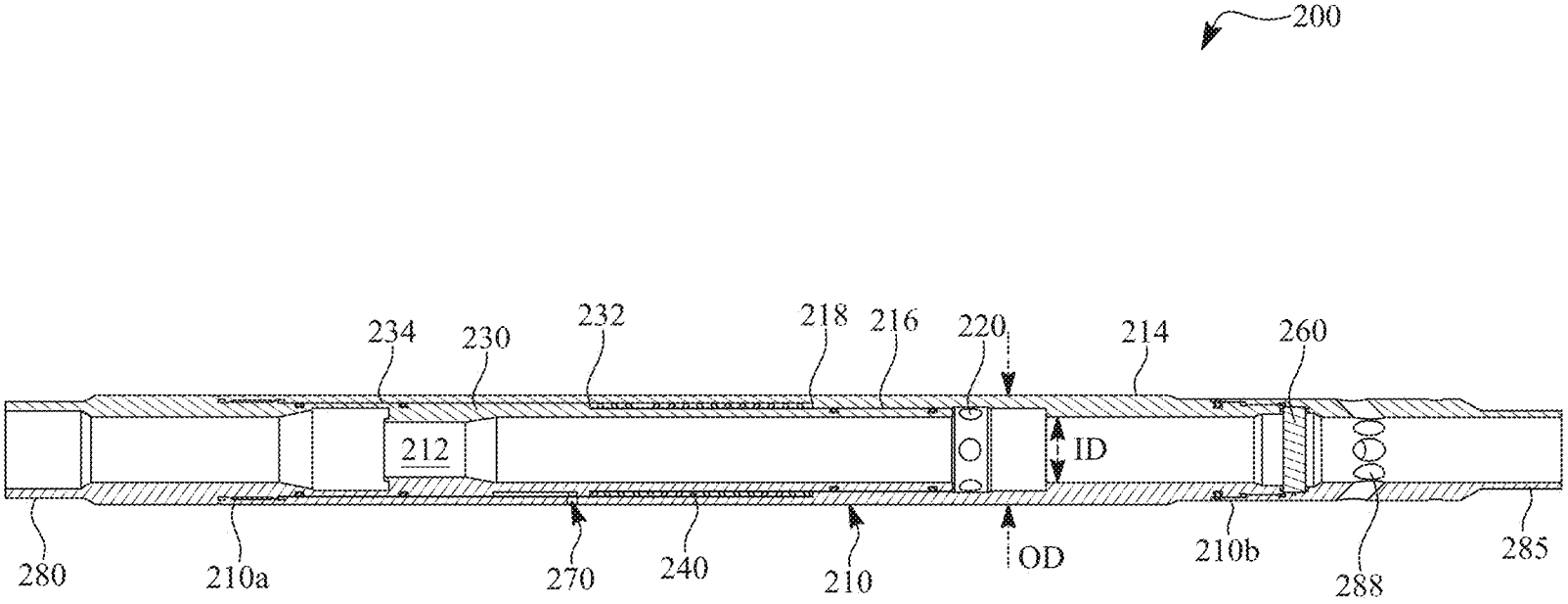
Figure 2E:
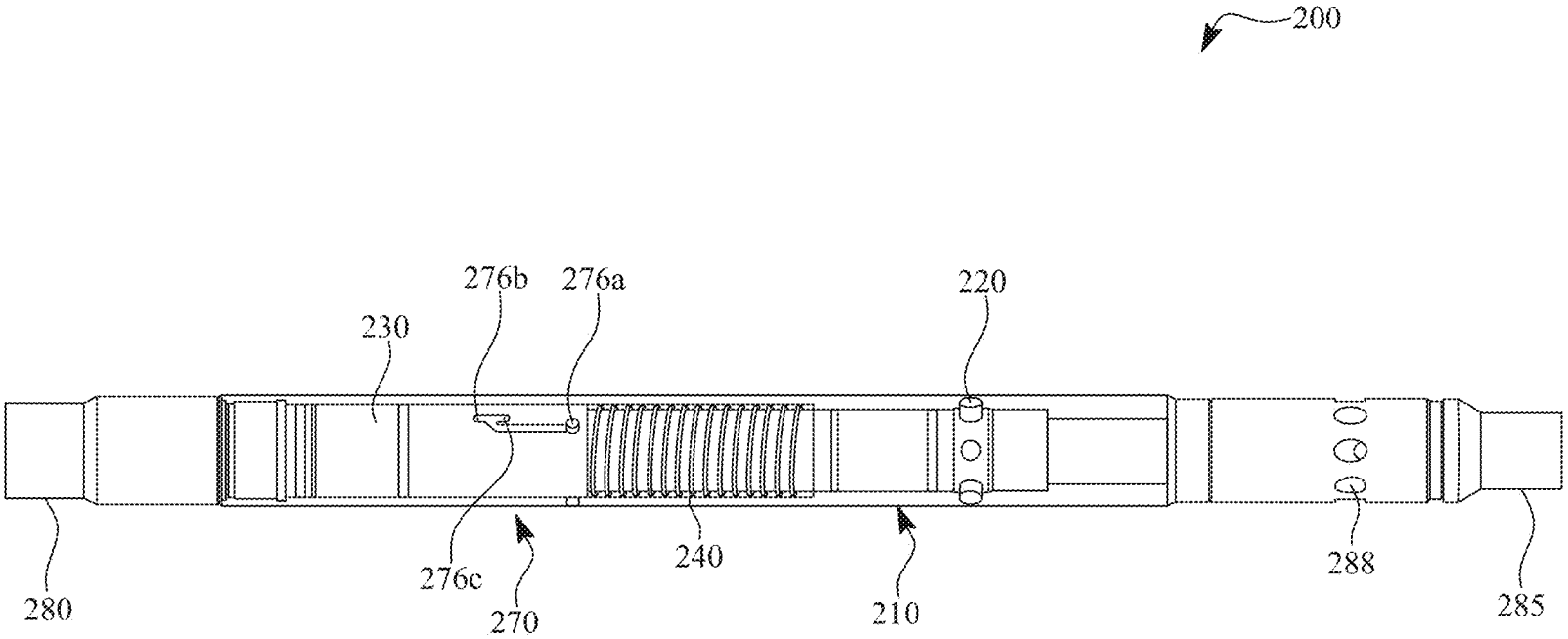
Figure 2F:
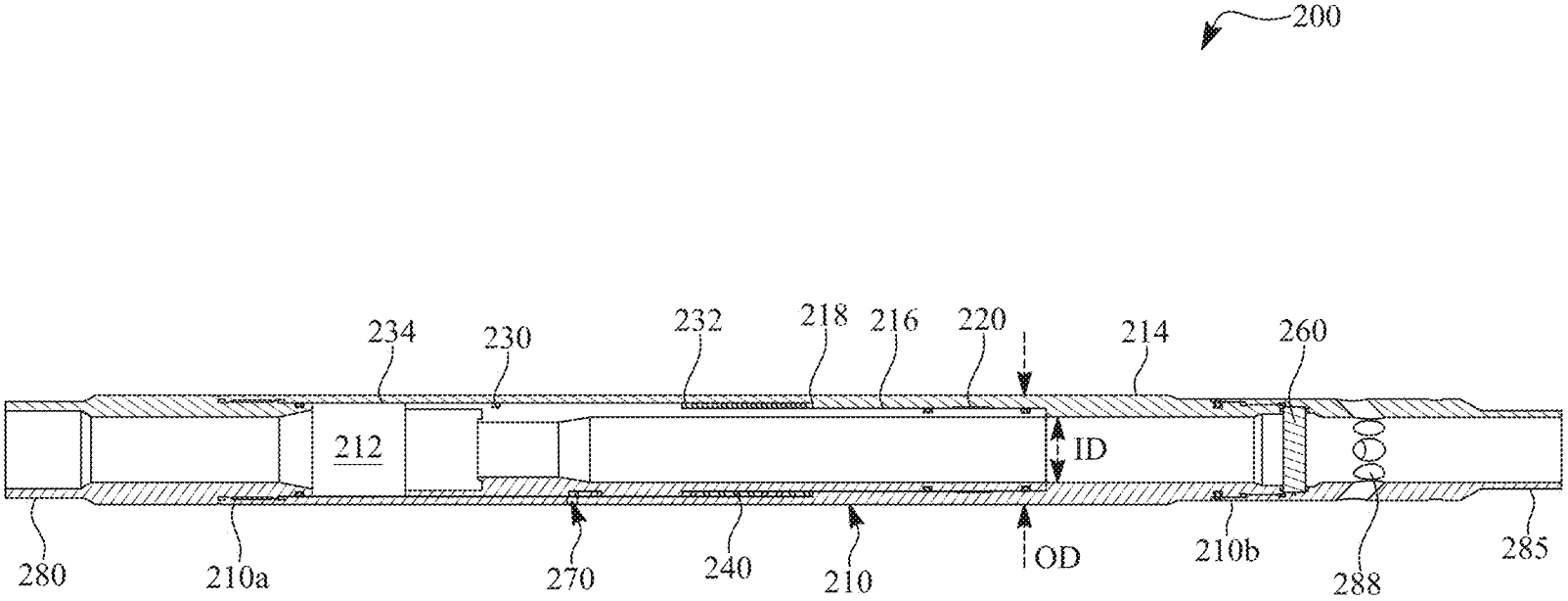
Figure 2G:
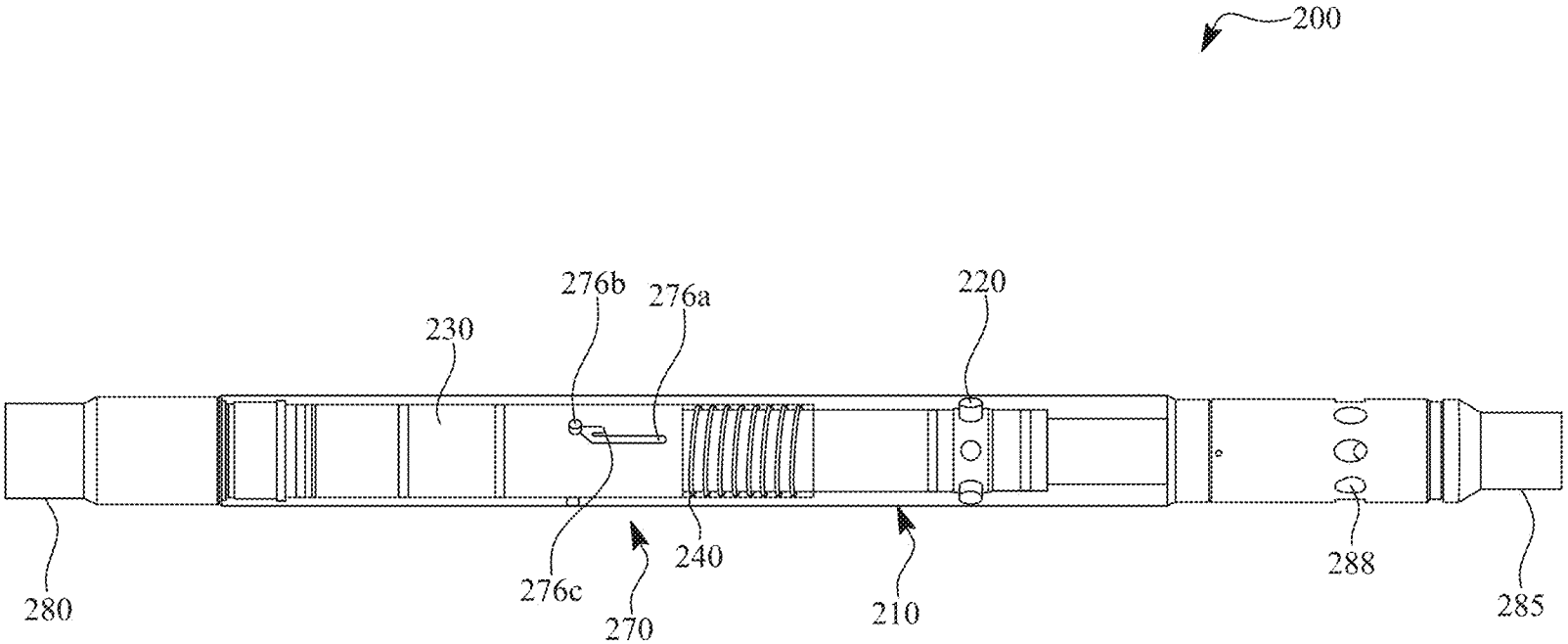
Figure 2H:
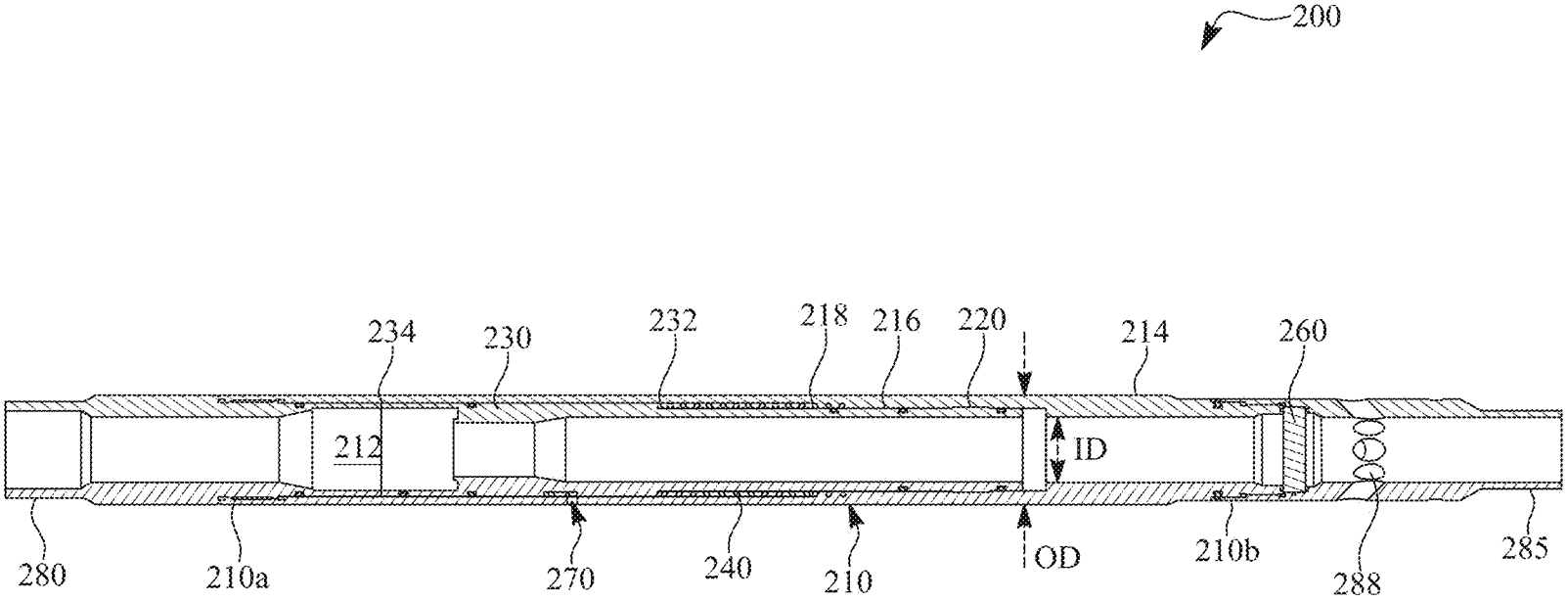
Figure 2I:
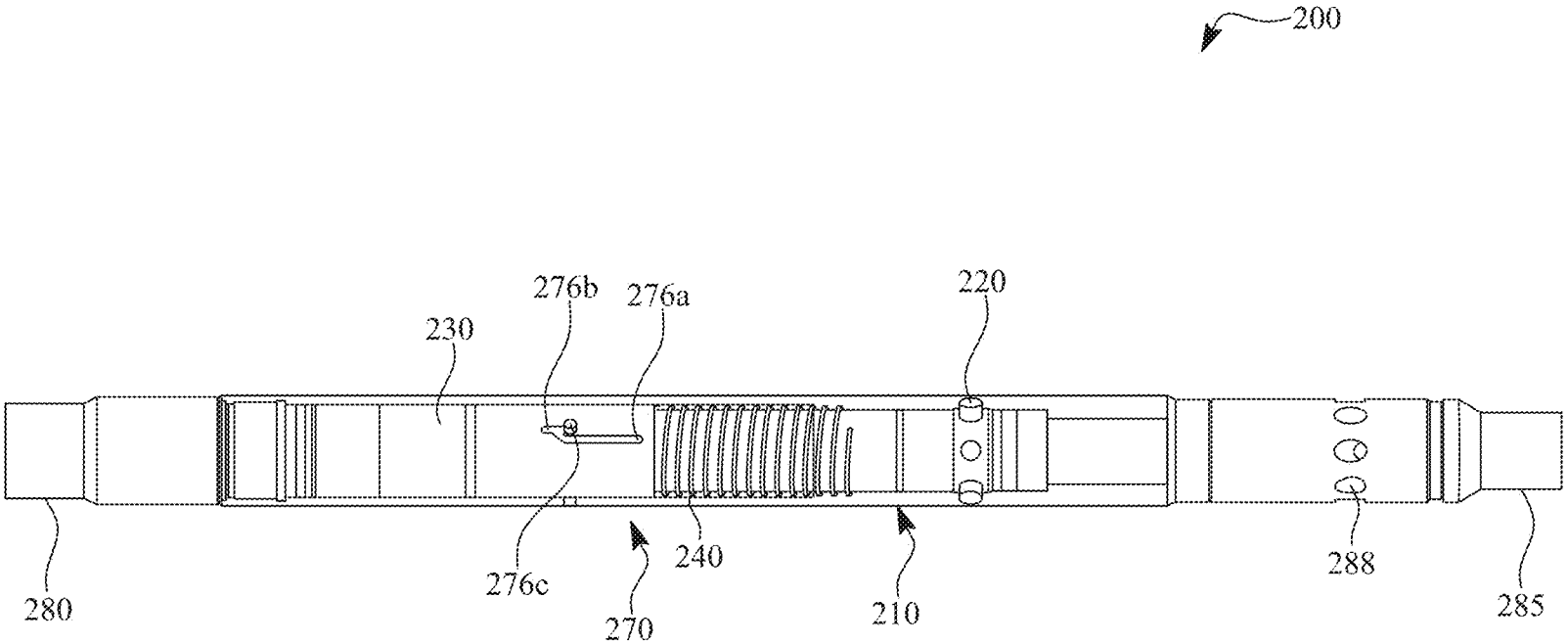
Figure 2J:
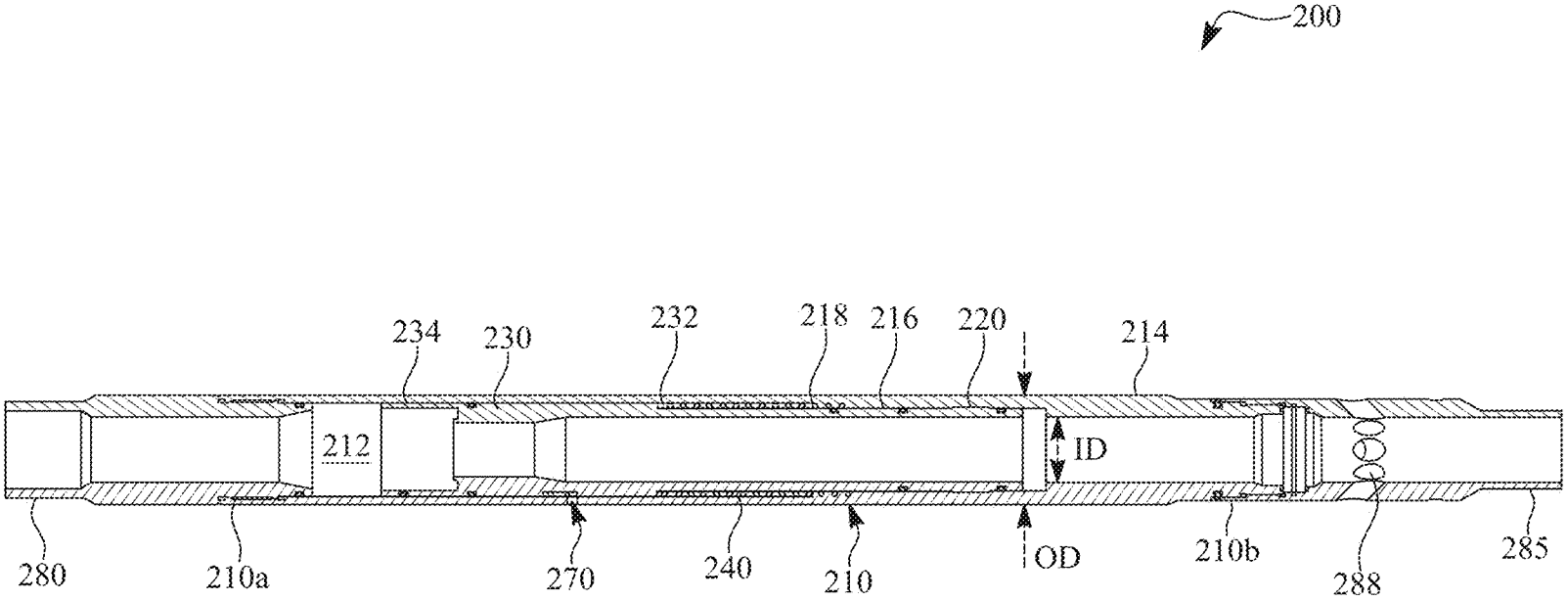
Figure 2K:
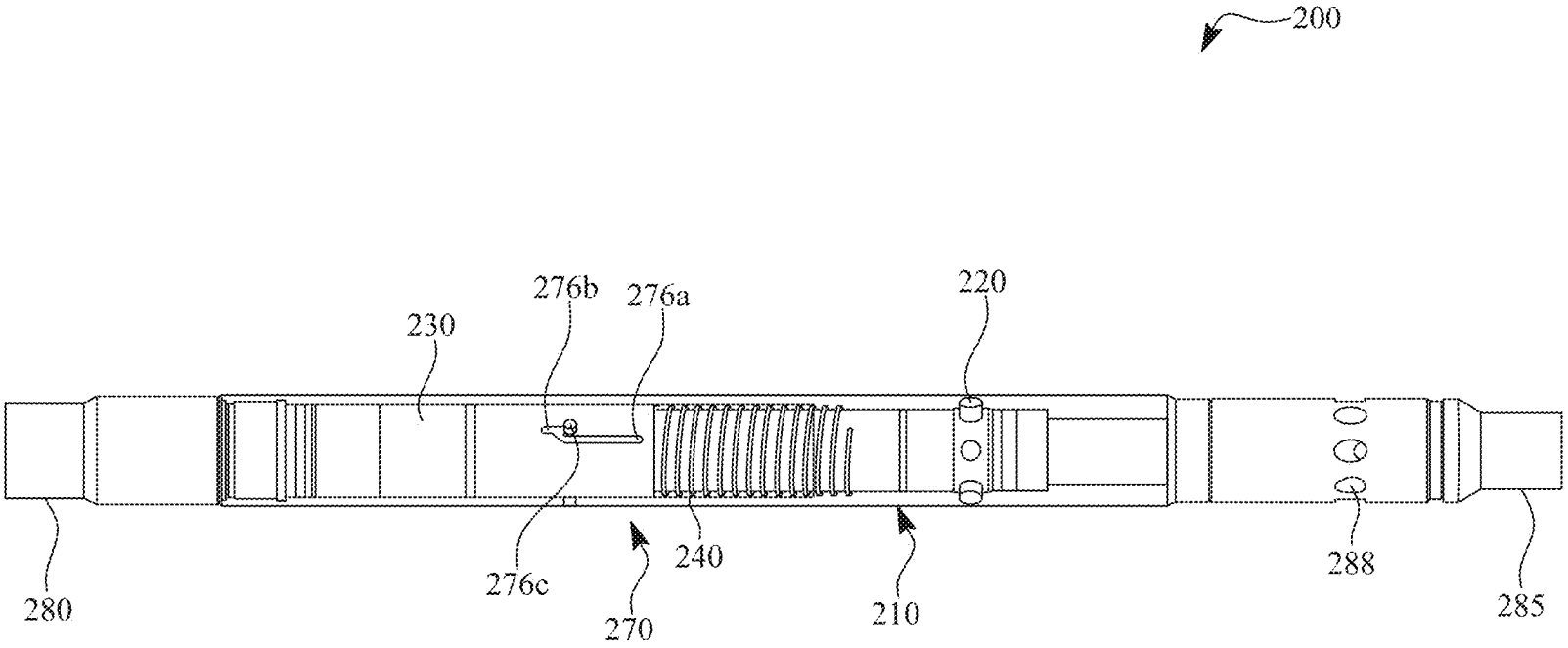

Turning now to FIGS. 2A through 2K, illustrated are various different views of various different operational steps of a downhole isolation tool 200 designed, manufactured and/or operated according to one or more embodiments of the disclosure, as might be used within the well system 100 of FIG. 1. FIG. 2A illustrates an isometric view of the downhole isolation tool 200, for example in its run-in-hole state. FIG. 2B illustrates an isometric view with partial cutaway of the downhole isolation tool 200, for example in its run-in-hole state. FIG. 2C illustrates an isometric view with partial transparency of the downhole isolation tool 200, for example in its run-in-hole state. FIGS. 2D and 2E illustrate a cross-sectional view and a partial transparency view, respectively, of the downhole isolation tool 200 in its run-in-hole state. FIGS. 2F and 2G illustrate a cross-sectional view and a partial transparency view, respectively, of the downhole isolation tool 200 in its intermediate compressed state. FIGS. 2H and 21 illustrate a cross-sectional view and a partial transparency view, respectively, of the downhole isolation tool 200 in its final compressed state, but with its sacrificial plug member remaining intact. FIGS. 2J and 2K illustrate a cross-sectional view and a partial transparency view, respectively, of the downhole isolation tool 200 in its final compressed state, but with its sacrificial plug member ruptured.

With reference to FIGS. 2A through 2K, the downhole isolation tool 200 includes an outer housing 210. The outer housing 210, in one or more embodiments, includes an uphole end 210*a* and a downhole end 210*b*, as well as a fluid passageway 212 extending along a length (L) thereof. In at least one embodiment, the outer housing 210 additionally includes an outer housing exterior surface 214, as well as an outer housing interior surface 216. In at least one embodiment, the outer housing 210 is a tubular, and thus would have an outside diameter (OD) and an inside diameter (ID).

The downhole isolation tool 200, in one or more embodiments, further includes one or more fluid flow ports 220 (e.g., one or more uphole fluid flow ports) connecting the fluid passageway 212 and the outer housing exterior surface 214. Any number of fluid flow ports 220 may be used and remain within the scope of the disclosure, but in reality there will be less than two hundred fluid flow ports 220 in most any downhole isolation tool 200. Nevertheless, in at least one embodiment, there are at least two fluid flow ports 220, at least four fluid flow ports, at least six fluid flow ports, at least eight fluid flow ports 220, at least ten fluid flow ports 220, at least twenty fluid flow ports 220, etc.

The downhole isolation tool 200, in one or more embodiments, may further include an isolation sleeve 230 positioned within the fluid passageway 212. In at least one embodiment, the isolation sleeve 230 is configured to shift between an open state (e.g., as shown in FIGS. 2D and 2E) allowing fluid flow between the fluid passageway 212 and the outer housing exterior surface 214 (e.g., exposing the one or more fluid flow ports 220), and a closed state (e.g., as shown in FIGS. 2F through 2K) covering the one or more fluid flow ports 220 and obstructing fluid flow between the fluid passageway 212 and the outer housing exterior surface 214. In one or more embodiments, the isolation sleeve 230 is configured to axially shift, rotationally shift, or both axially and rotationally shift when moving between the open state and the closed state. In the embodiment of FIGS. 2A through 2K, the isolation sleeve 230 is configured to both axially and rotationally shift.

In one or more embodiments, the downhole isolation tool 200 includes a biasing spring 240 (e.g., mechanical spring, fluid spring, etc.) configured to shift, or at least help shift, the isolation sleeve 230. In at least one embodiment, the biasing spring 240 is coupled between the outer housing 210 and the isolation sleeve 230. For example, in at least one embodiment, the outer housing 210 has an outer housing shoulder 218 along the outer housing interior surface 216, and the isolation sleeve 230 has an isolation sleeve shoulder 232 along its isolation sleeve exterior surface 234. In this embodiment, the biasing spring 240 would be coupled with the outer housing shoulder 218 and the isolation sleeve shoulder 232, for example to bias the isolation sleeve 230 in a given direction. In the illustrated embodiment of FIGS. 2A through 2K, the biasing spring 240 is configured to bias the isolation sleeve 230 away from a sacrificial plug member (e.g., sacrificial plug member 260 discussed in greater detail below). Nevertheless, in yet another embodiment, the biasing spring 240 is configured to bias the isolation sleeve 230 toward the sacrificial plug member.

In one or more embodiments, the downhole isolation tool 200 may further include a retention device 270 coupled between the outer housing 210 and the isolation sleeve 230. The retention device 270, in one or more embodiments, is configured to keep the isolation sleeve 230 in the closed state after having moved from the open state, or vice versa. Any number of different types of retention devices 270 may be used and remain within the scope of the present disclosure. In at least one embodiment, such as shown, the retention device 270 is a J-slot/pin retention device. For example, in at least one embodiment, the J-slot/pin retention device includes a J-slot 272 in one of the outer housing 210 or isolation sleeve 230, and a pin 274 in an other of the isolation sleeve 230 or outer housing 210. In the illustrated embodiment, the J-slot 272 is located in the sliding sleeve 230, and the pin 274 is located in the outer housing 210, but the opposite could hold true. Notwithstanding the foregoing, in at least one other embodiment, as will be discussed in greater detail below, the retention device 270 is a snap ring/snap ring grove retention device or body lock ring retention device, among others.

In at least one embodiment, the J-slot/pin retention device has a run-in-hole slot position 276*a*, for example configured to keep the isolation sleeve 230 in the open state. In at least one other embodiment, the J-slot/pin retention device has an intermediate compressed slot position 276*b*. In yet another embodiment, the J-slot/pin retention device has a final compressed slot position 276*c*, for example configured to keep the isolation sleeve 230 in the closed state after having moved from the open state. Thus, in the illustrated embodiment, the J-slot/pin retention device includes three discrete positions. In yet another embodiment, however, the J-slot/pin retention device could include only two discrete positions, or could include four or more discrete positions (e.g., with a limit of 100 or less discrete positions).

In the illustrated embodiment of FIGS. 2A through 2K, the downhole isolation tool 200 additionally includes an uphole end sub 280 coupled to the uphole end 210*a* of the outer housing 210 and a downhole end sub 285 coupled to the downhole end 210*b* of the outer housing 210. Furthermore, in at least one embodiment, the one or more fluid flow ports 220 are one or more uphole fluid flow ports, and the downhole isolation tool 200 further includes one or more downhole fluid flow ports 288. In the illustrated embodiment of FIGS. 2A through 2K, the one or more downhole fluid flow ports 288 are located in the downhole end sub 285, the one or more downhole fluid flow ports 288 configured to provide fluid flow around a sacrificial plug member when the isolation sleeve 230 is in the open state. While the embodiment of FIGS. 2A through 2K depicts the one or more downhole fluid flow ports 288 in the downhole end sub 285, they could also be located in the outer housing 210 (e.g., so long as they are downhole of the sacrificial plug member) or below the downhole end sub 285.

In the illustrated embodiment of FIGS. 2A through 2K, the downhole isolation tool 200 includes a sacrificial plug member 260 fluidly coupled with the fluid passageway 212, for example downhole of the one or more fluid flow port 220. The sacrificial plug member 260, in this embodiment, is configured to seal fluid flow through the fluid passageway 212 while it is intact, but allow fluid flow through the fluid passageway 212 when it has been ruptured. In one or more embodiments, the sacrificial plug member 260 is positioned between the downhole end 210*b* of the outer housing 210 and the downhole end sub 285. In yet another embodiment, the sacrificial plug member 260 is located in the outer housing 210, in the downhole end sub 285, or below the downhole end sub 285, among other locations.

The sacrificial plug member 260 may comprise a variety of different materials and remain within the scope of the disclosure. In at least one embodiment, the sacrificial plug member 260 comprises a material that may be ruptured and/or broken into a plurality of smaller pieces. In yet another embodiment, the sacrificial plug member 260 comprises a material that may be drilled or milled. In even yet another embodiment, the sacrificial plug member 260 comprises a dissolvable material. In the embodiment of FIGS. 2A through 2K, however, the sacrificial plug member 260 comprises a glass sacrificial plug or a ceramic sacrificial plug, as each of these materials may be easily ruptured, and ideally will break in to many small pieces and flow downhole without concern.

Turning specifically to FIGS. 2D and 2E, the downhole isolation tool 200 is illustrated in the run-in-hole state. Accordingly, the isolation sleeve 230 is in its open state, thus does not cover the one or more fluid flow ports 220, which allows for fluid flow circulation around the sacrificial plug member 260, which again has yet to be ruptured. Furthermore, the J-slot 272 and pin 274 of the retention device 270 are located in their run-in-hole slot position 276*a*.

Turning now specifically to FIGS. 2F and 2G, illustrated is the downhole isolation tool 200 of FIGS. 2D and 2E after applying pressure within the fluid passageway 212. In this instance, the pressure within the fluid passageway 212 slides the isolation sleeve 230 from its open state (e.g., as shown in FIGS. 2D and 2E) to its initial closed state (e.g., as shown in FIGS. 2F and 2G). Accordingly, at this stage, the isolation sleeve 230 now covers the one or more fluid flow ports 220, and thus prevents fluid flow circulation around the sacrificial plug member 260, which again has yet to be ruptured. Furthermore, the J-slot 272 and pin 274 of the retention device 270 are now located in their intermediate compressed slot position 276*b*.

Turning now specifically to FIGS. 2H and 21, illustrated is the downhole isolation tool 200 of FIGS. 2F and 2G after reducing the applied pressure within the fluid passageway 212. In this instance, the reduced pressure within the fluid passageway 212, along with the spring member 240, slides the isolation sleeve 230 from its initial closed state (e.g., as shown in FIGS. 2F and 2G) to its final closed state (e.g., as shown in FIGS. 2H and 21). Accordingly, at this stage, the isolation sleeve 230 still covers the one or more fluid flow ports 220, and in fact is locked in the final closed state, and thus prevents fluid flow circulation around the sacrificial plug member 260, which again has yet to be ruptured. Furthermore, the J-slot 272 and pin 274 of the retention device 270 are now located in their final compressed slot position 276*c*.

Turning now specifically to FIGS. 2J and 2K, illustrated is the downhole isolation tool 200 of FIGS. 2H and 21 after rupturing the sacrificial plug member 260 (e.g., rupturing the sacrificial plug member after moving the isolation sleeve to the closed state). In the embodiment of FIGS. 2J and 2K, the sacrificial plug member 260 is ruptured using a conveyance, such as a conveyance from the surface. Thus, according to this embodiment, an additional intervention is required to rupture the sacrificial plug member 260. In other embodiments, however, the sacrificial plug member 260 is ruptured in an interventionless manner.

Figure 3A:
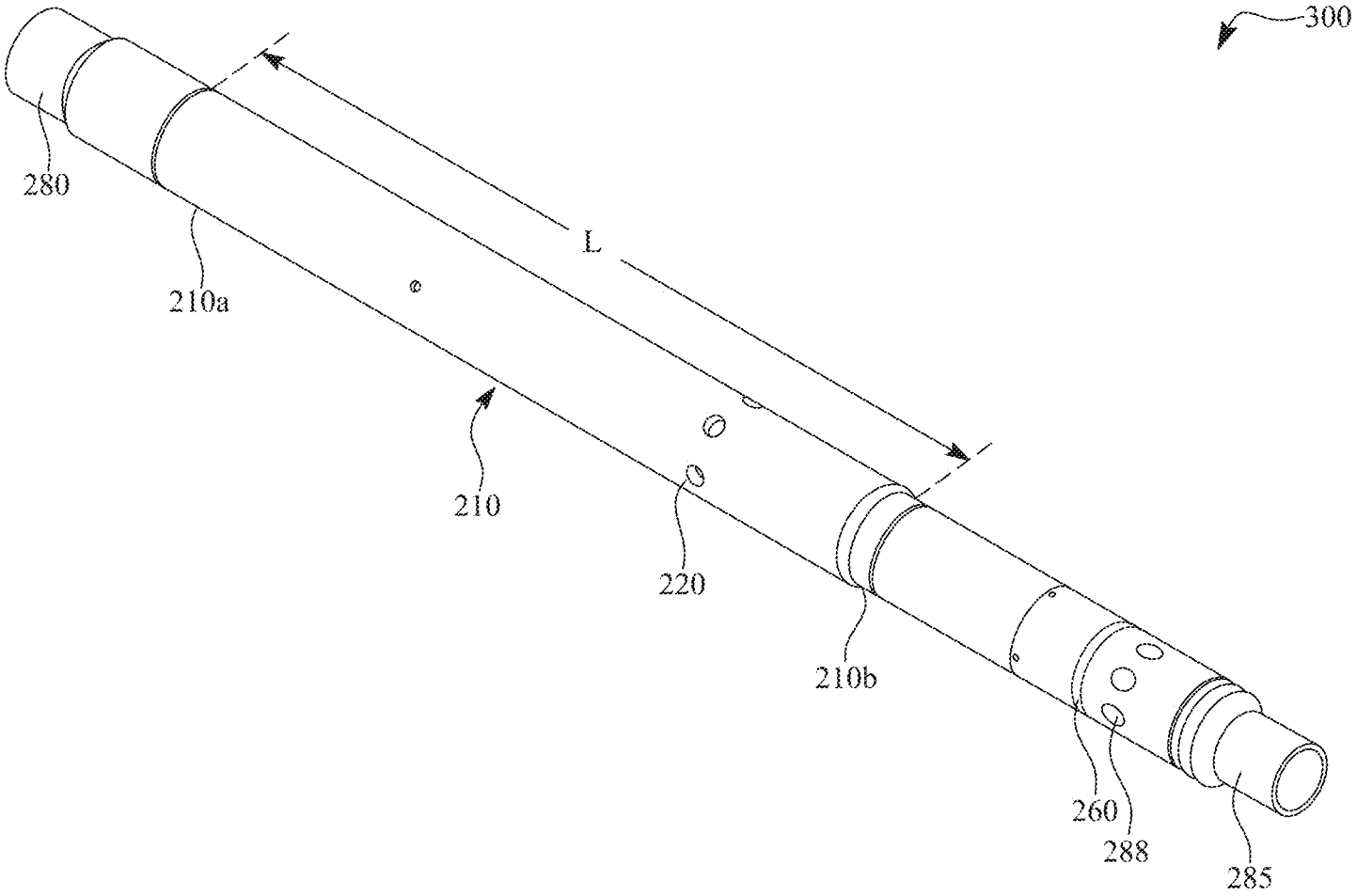
FIGS. 3A through 3K illustrate a downhole isolation tool designed, manufactured and/or operated according to one or more alternative embodiments of the disclosure.
Figure 3B:
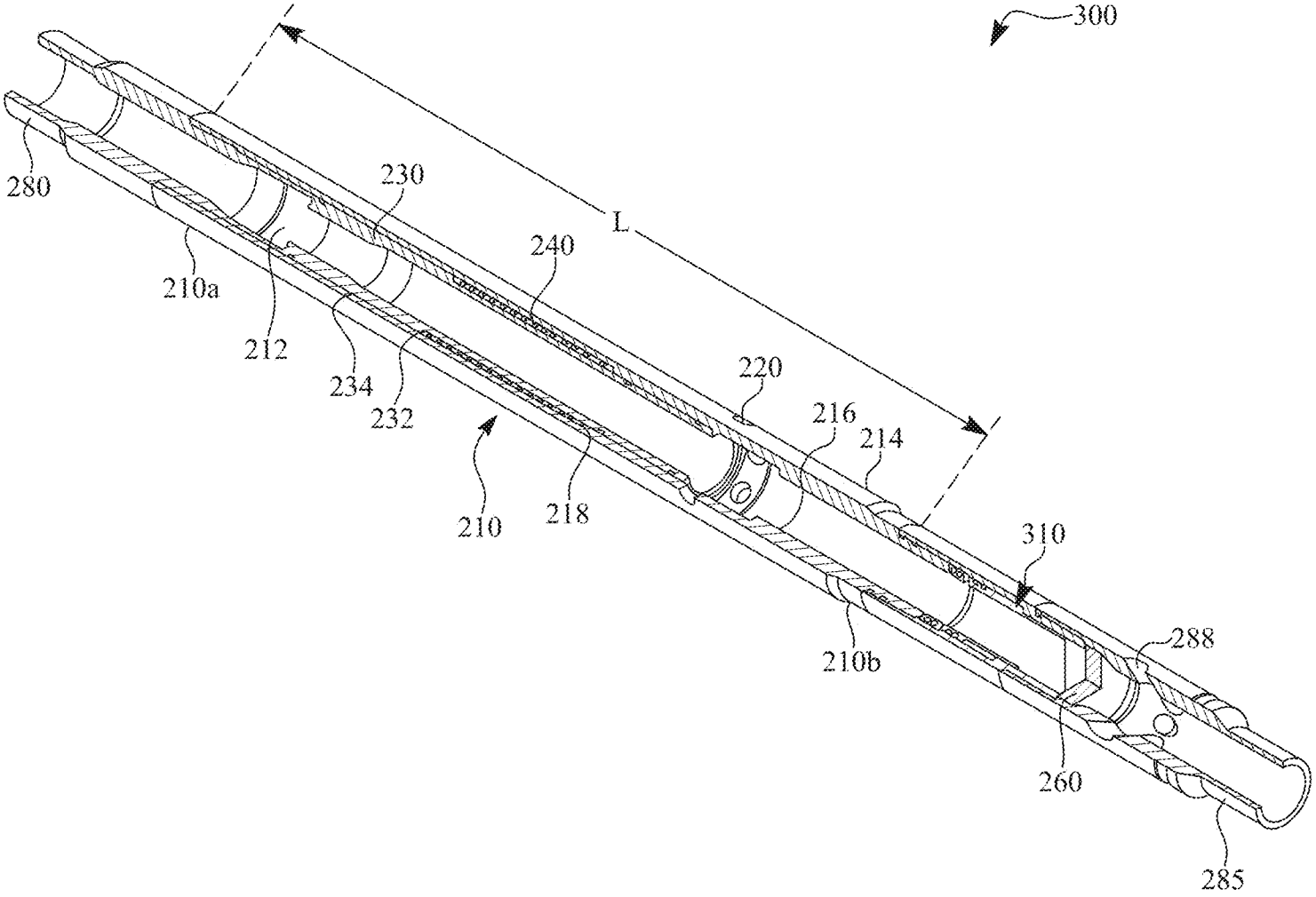
Figure 3C:
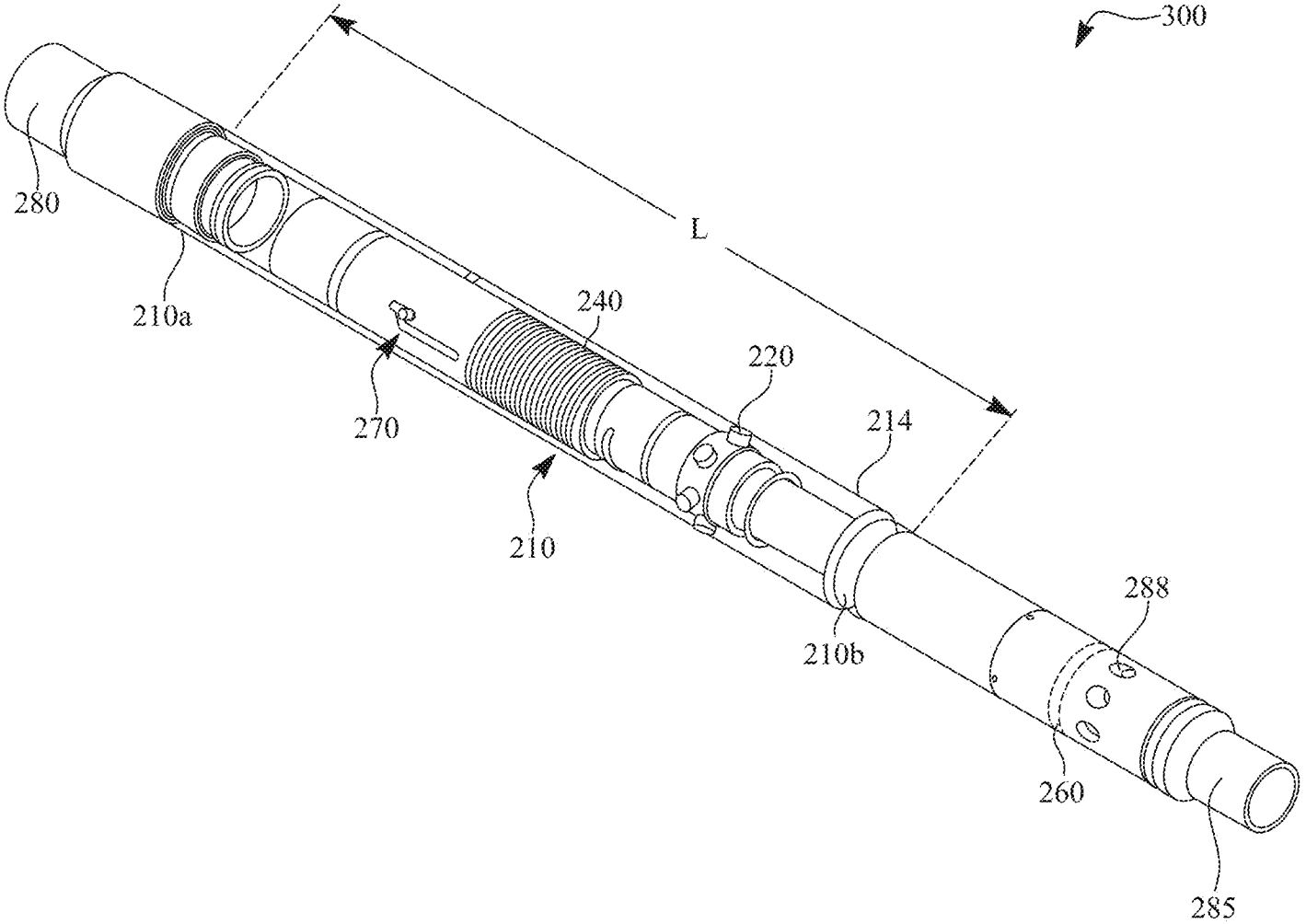
Figure 3D:
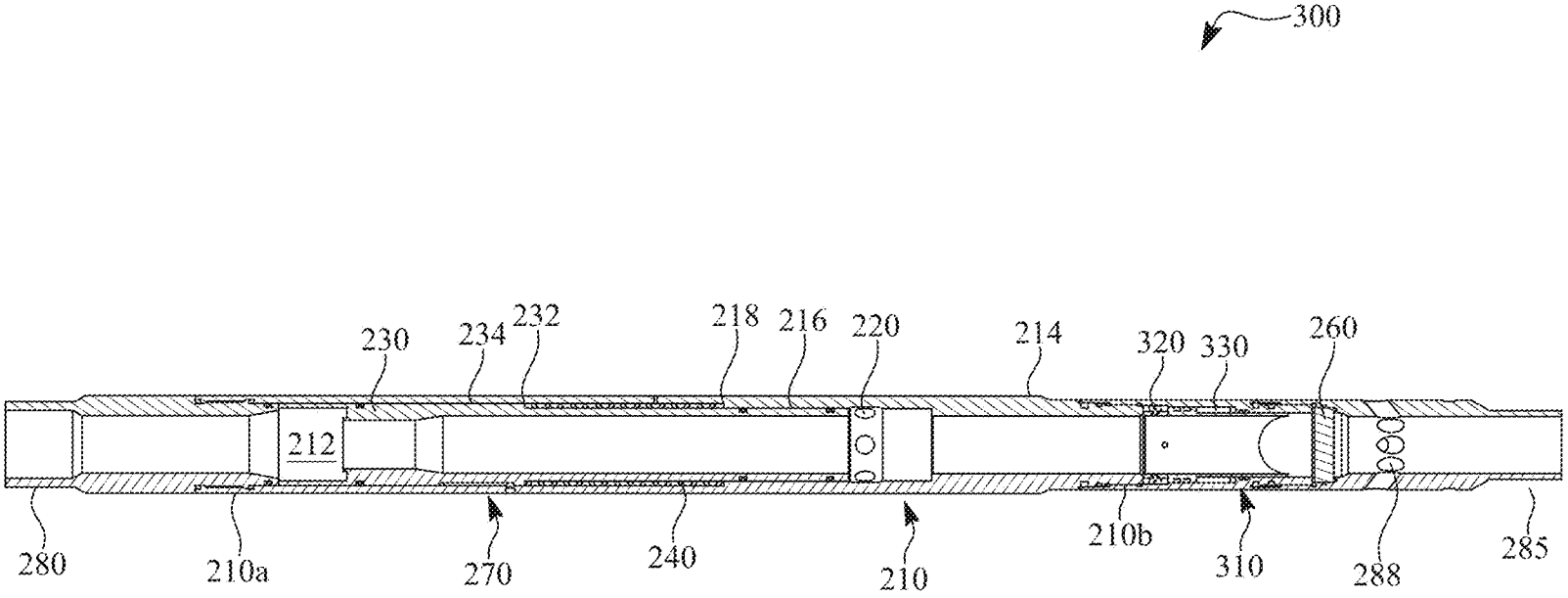
Figure 3E:
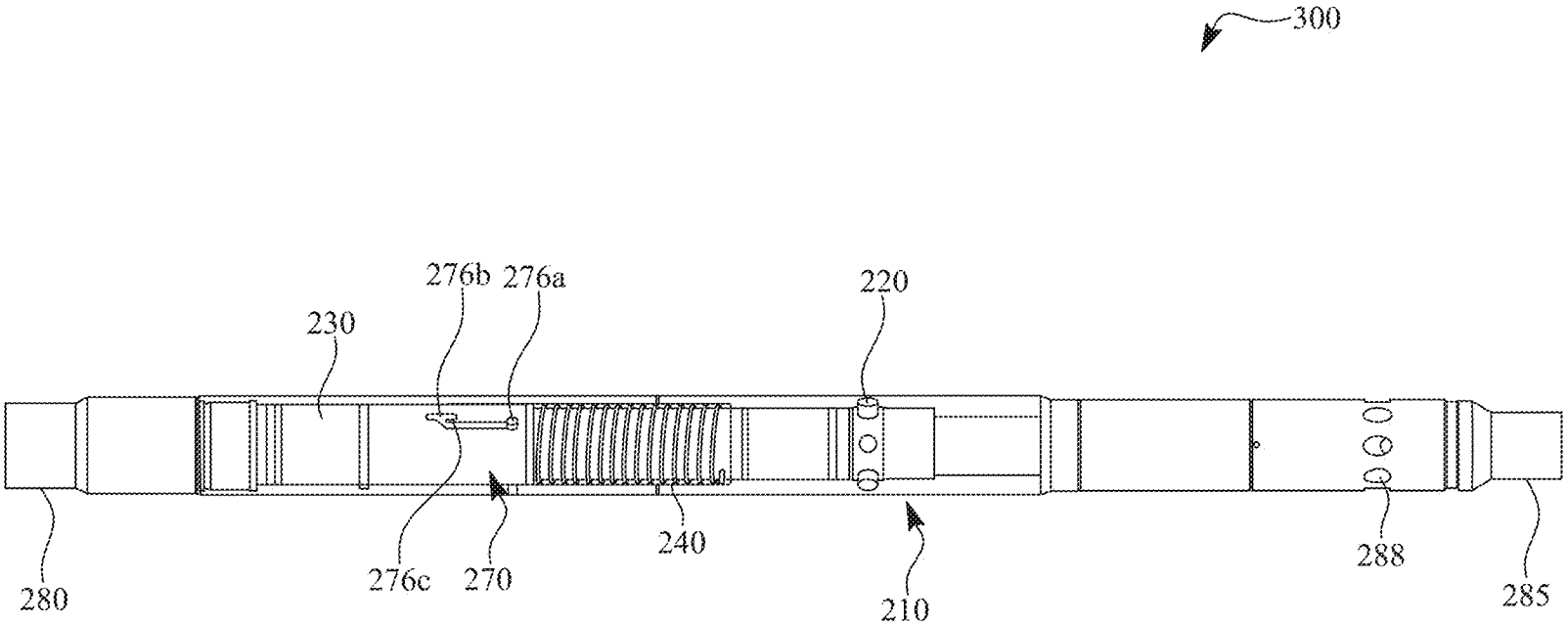
Figure 3F:
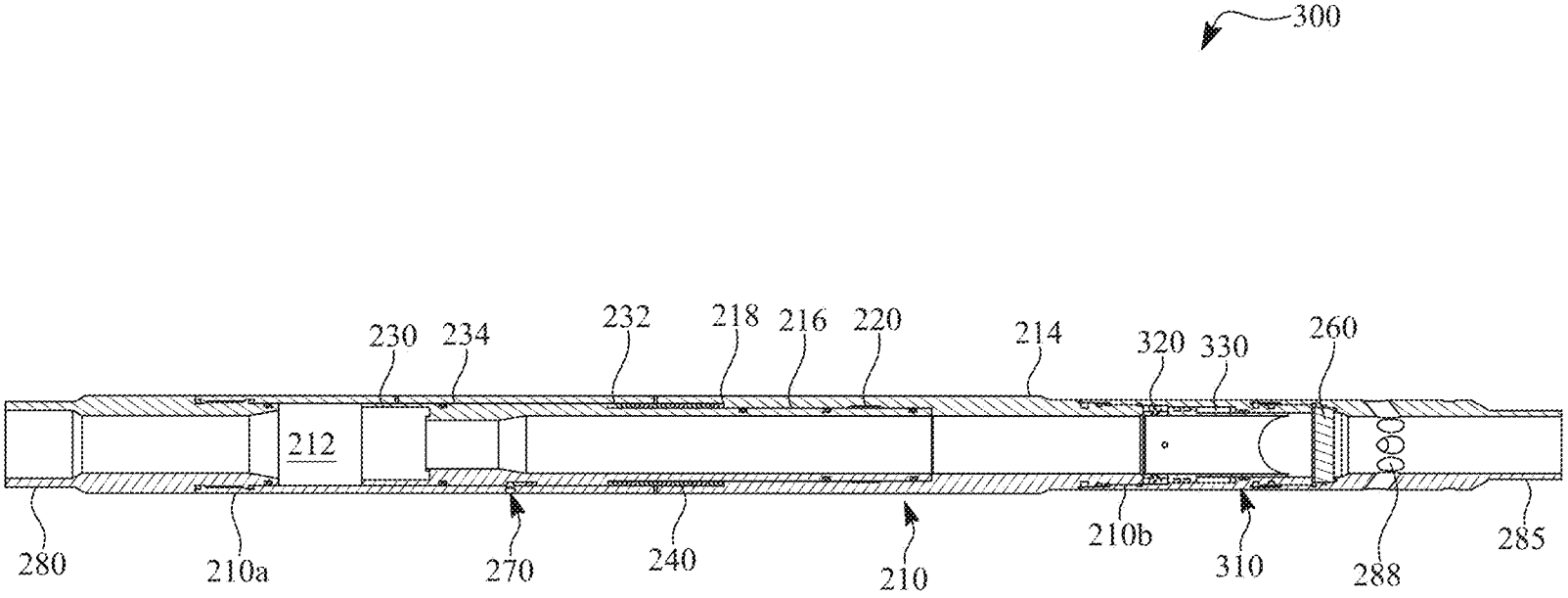
Figure 3G:
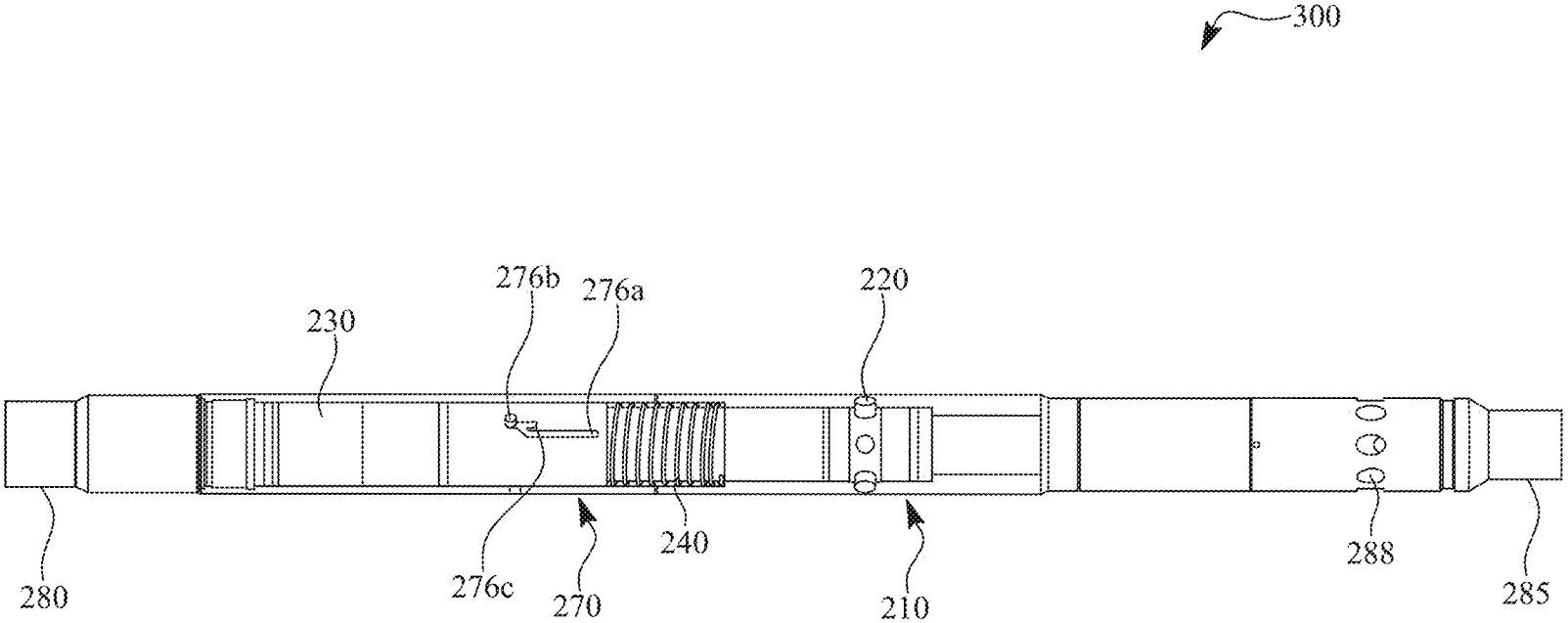
Figure 3H:
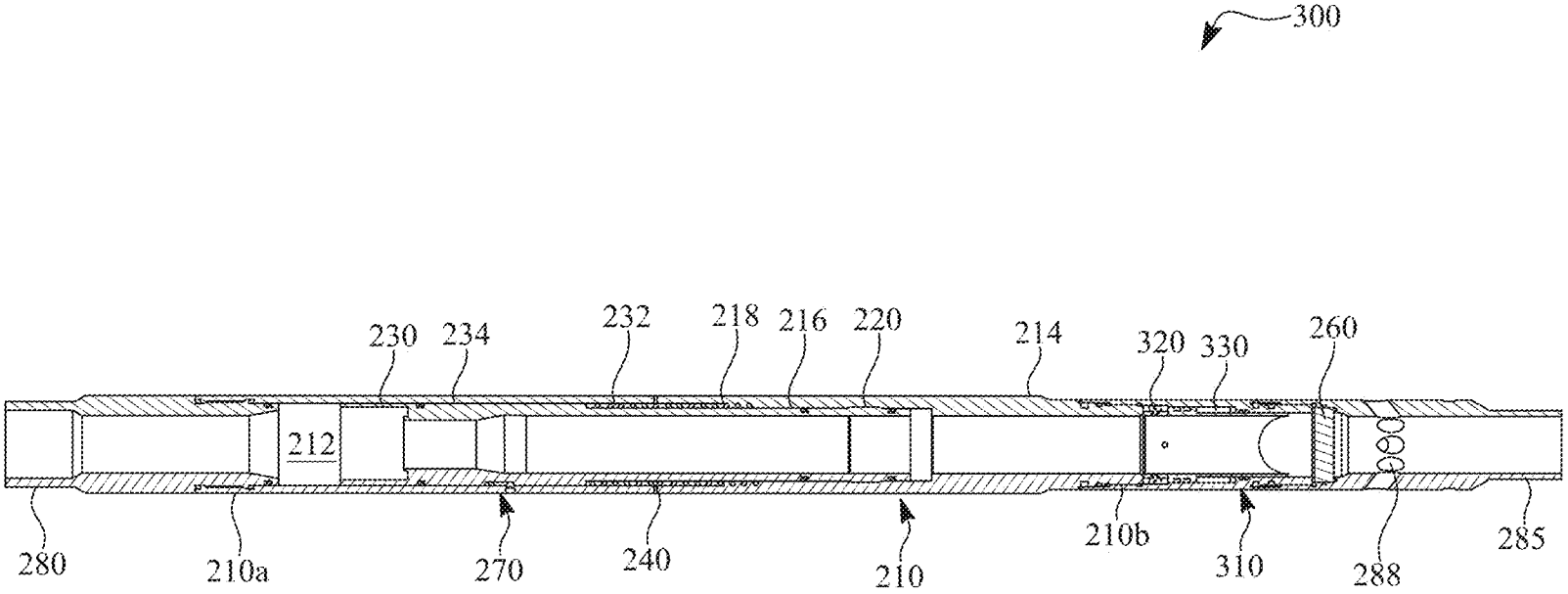
Figure 3I:
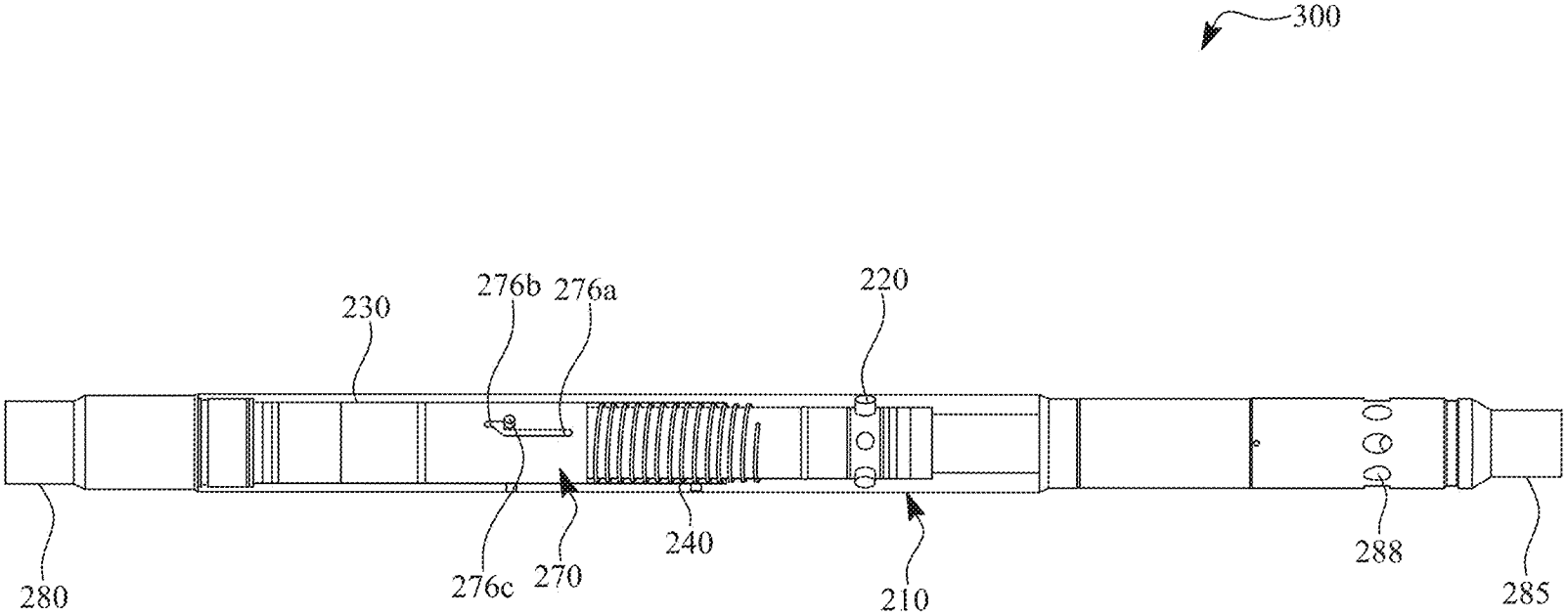
Figure 3J:
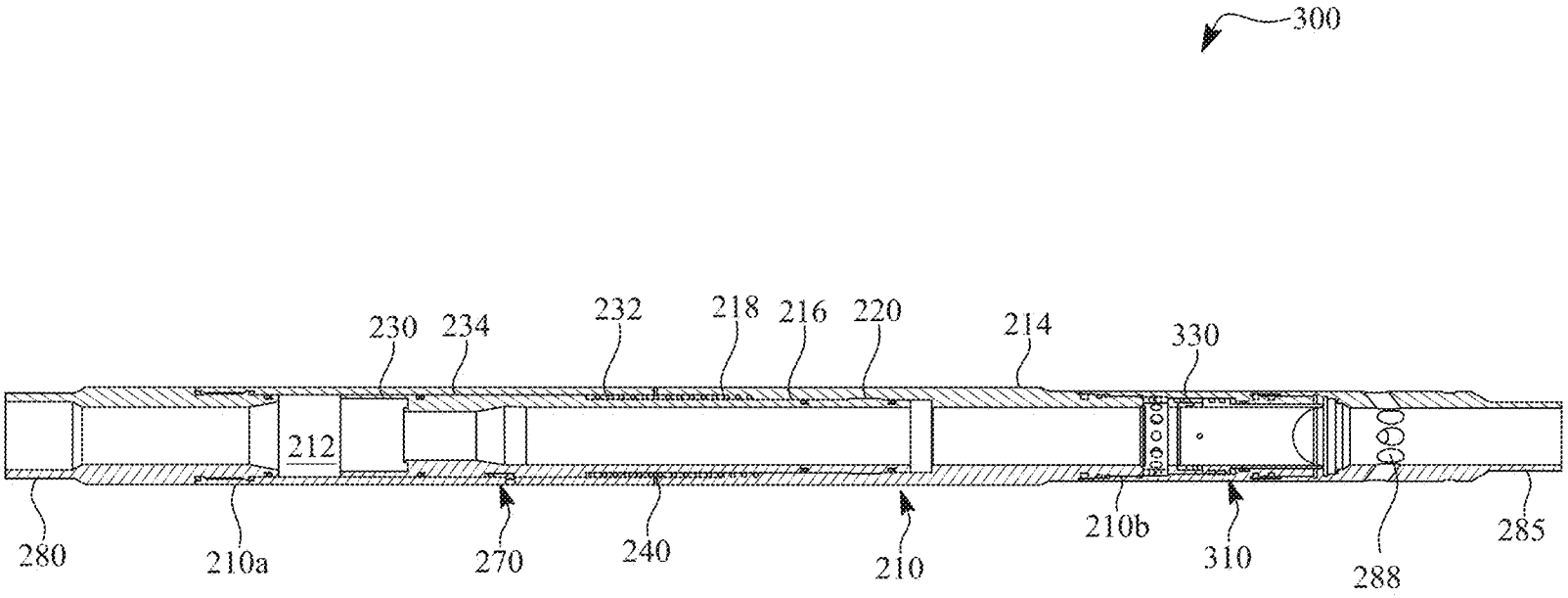
Figure 3K:
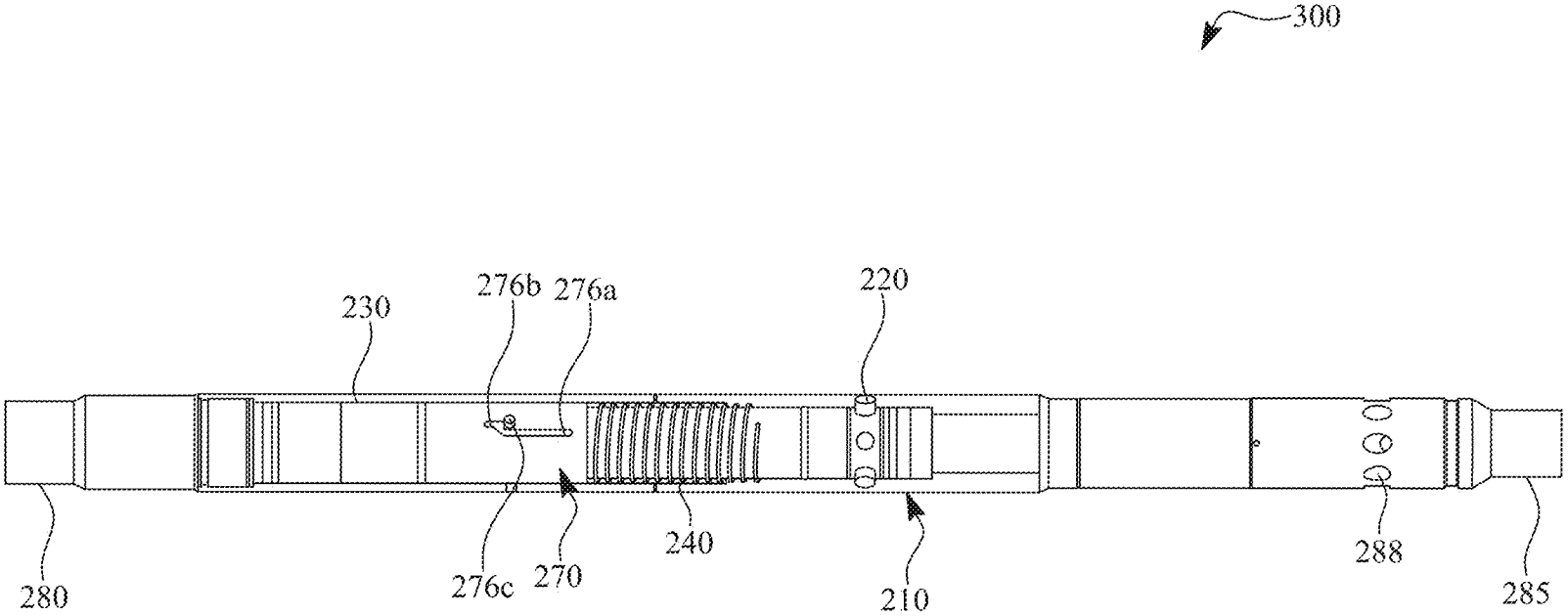
Figure 4A:
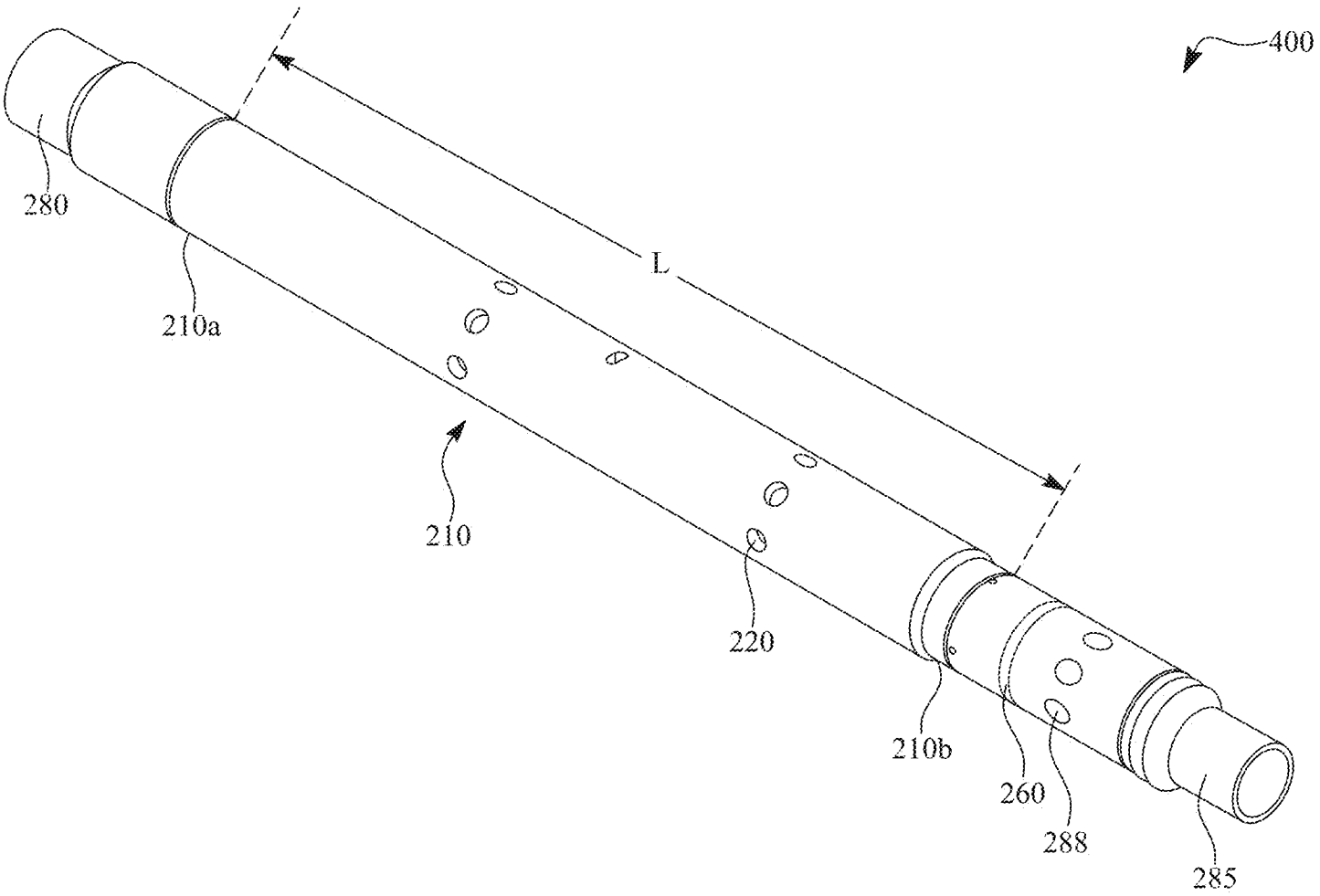
FIGS. 4A through 4D illustrate a downhole isolation tool designed, manufactured and/or operated according to one or more alternative embodiments of the disclosure.
Figure 4B:
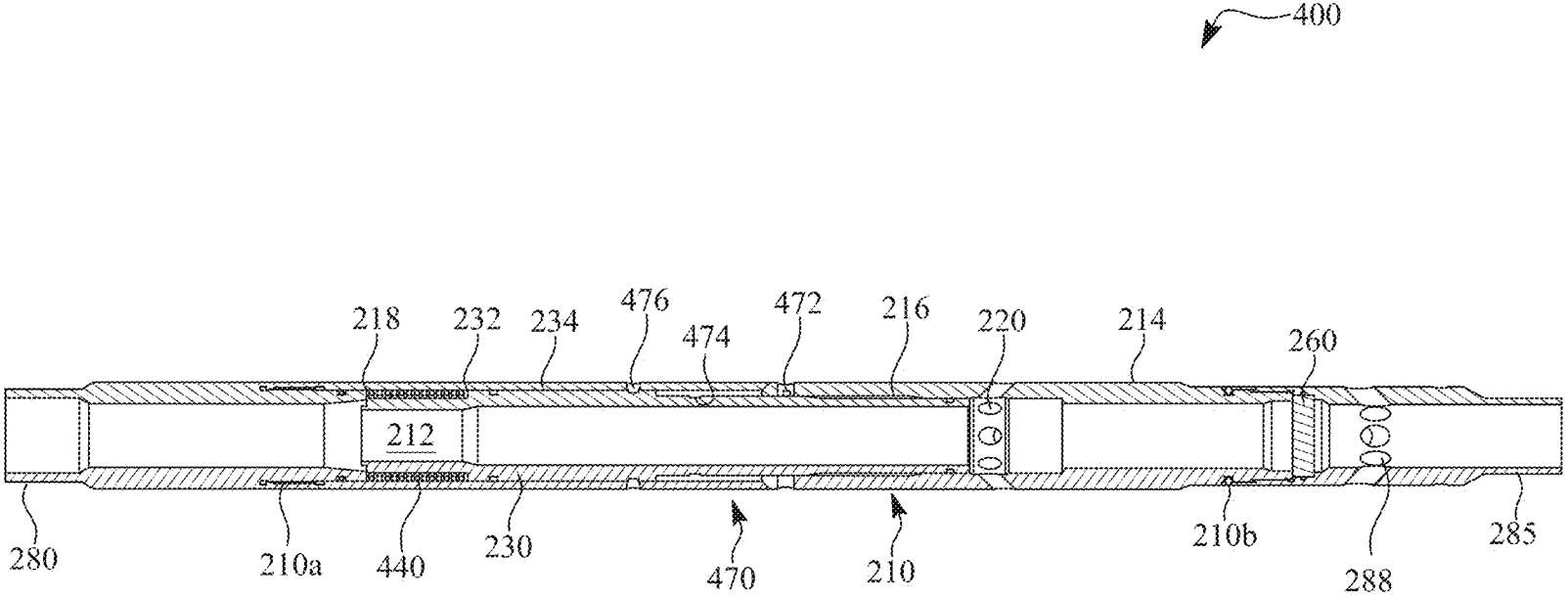
Figure 4C:
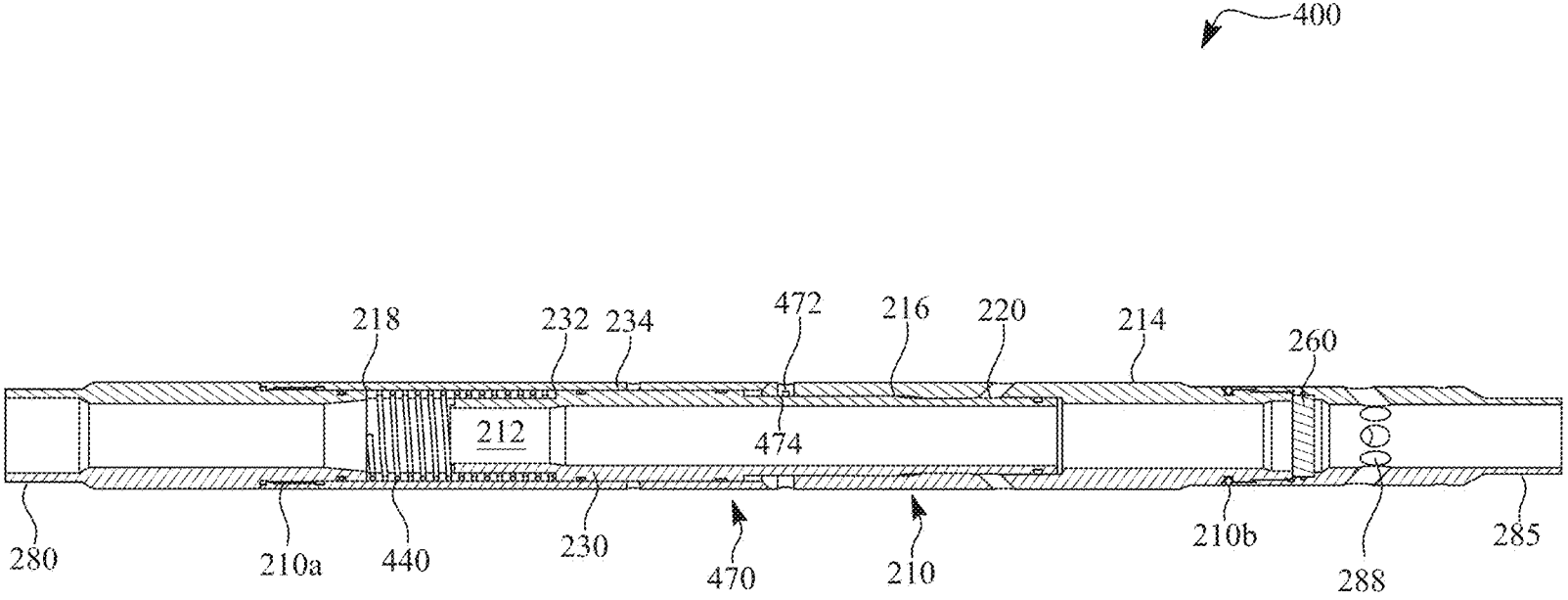
Figure 4D:
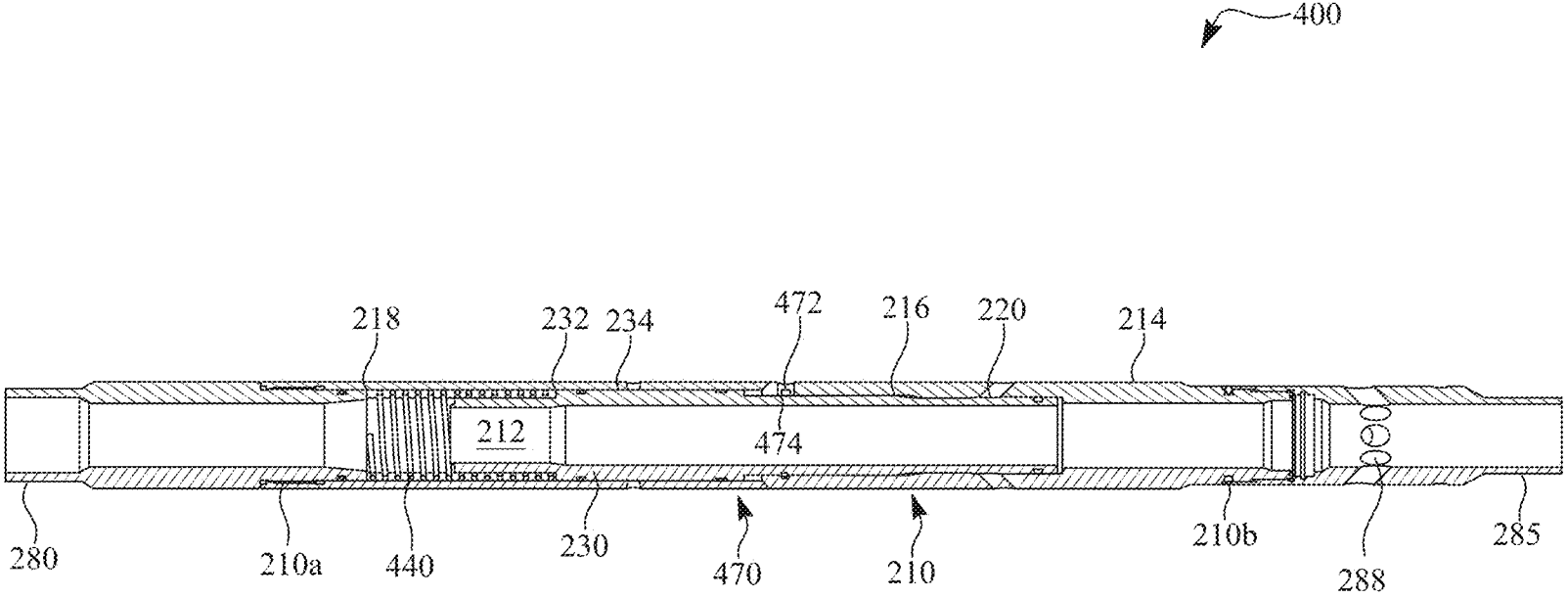

Turning now to FIGS. 3A through 3K, illustrated is a downhole isolation tool 300 designed, manufactured and/or operated according to one or more alternative embodiments of the disclosure. The downhole isolation tool 300 of FIGS. 3A through 3K is similar in many respects to the downhole isolation tool 200 of FIGS. 2A through 2K. Accordingly, like reference numbers have been used to indicate similar, if not identical, features. The downhole isolation tool 300 differs, for the most part, from the downhole isolation tool 200, in that the downhole isolation tool 300 includes a sacrificial plug rupture device 310 located proximate and uphole of the sacrificial plug member 260. The sacrificial plug rupture device 310, in one or more embodiments, is configured to move from an undeployed state (e.g., as shown in FIGS. 3A through 3I) leaving the sacrificial plug member 260 intact (e.g., while the isolation sleeve 230 is in the open state) to a deployed state (e.g., as shown in FIGS. 3J and 3K) rupturing the sacrificial plug member 260 (e.g., after the isolation sleeve 230 has moved to the closed state). Accordingly, the sacrificial plug rupture device 310 allows for the interventionless removal of the sacrificial plug member 260.

The sacrificial plug rupture device 310 may comprise a variety of different features and remain within the scope of the disclosure. Nevertheless, in at least one embodiment, the sacrificial plug rupture device 310 includes a shear feature 320 configured to hold it in the undeployed state, and a spring member 330 configured to move it to the deployed state. For example, in at least one embodiment, the spring member 330 is a fluid pressure spring member (e.g., a vacuum fluid chamber or atmospheric fluid chamber activation member) configured to move (e.g., quickly move with a degree of force sufficient to rupture the sacrificial plug member 260) the sacrificial plug rupture device 310 to the deployed state, and in doing so rupture the sacrificial plug member 260. In yet another embodiment, the spring member 330 is a mechanical spring member, as opposed to a hydraulic spring member.

In the disclosed embodiment of FIGS. 3A through 3K, after the sliding sleeve 230 is located in the final compressed position, additional pressure may be placed down upon the sacrificial plug member 260, and in doing so upon the sacrificial plug rupture device 310. Once the additional pressure reaches a predetermined level, the shear feature 320 would shear, thereby releasing the sacrificial plug rupture device 310, and thus allowing the sacrificial plug rupture device 310 to move to the deployed state and rupture the sacrificial plug member 260.

Turning now to FIGS. 4A through 4D, illustrated is a downhole isolation tool 400 designed, manufactured and/or operated according to one or more alternative embodiments of the disclosure. The downhole isolation tool 400 of FIGS. 4A through 4D is similar in many respects to the downhole isolation tool 200 of FIGS. 2A through 2K. Accordingly, like reference numbers have been used to indicate similar, if not identical, features. The downhole isolation tool 400 differs, for the most part, from the downhole isolation tool 200, in that the downhole isolation tool 400 employs a snap ring/snap ring groove retention device 470. For example, in the illustrated embodiment, the snap ring/snap ring groove retention device 470 employs a snap ring 472 and a snap ring groove 474 to hold the isolation sleeve 230 in the closed state. In one or more embodiments, the snap ring 472 is located in one of the outer housing 210 or isolation sleeve 230 and a snap ring groove 474 in an other of the isolation sleeve 230 or outer housing 210. In the illustrated embodiment of FIGS. 4A through 4D, the snap ring 472 is located in the outer housing 210, while the snap ring groove 474 is located in the sliding sleeve 230, but the opposite could hold true.

The downhole isolation tool 400 of FIGS. 4A through 4D also differs from the downhole isolation tool 200, in that the downhole isolation tool 400 additionally employs a shear feature 476 for holding the sliding sleeve 230 in the open state. Furthermore, the downhole isolation tool 400 additionally employs a biasing spring 440 that is configured to bias the isolation sleeve 230 toward the sacrificial plug member 260.

Those skilled in the art to which this application relates will appreciate that other and further additions, deletions, substitutions and modifications may be made to the described embodiments.

What is claimed is:

1. A downhole tool, comprising:

a downhole isolation tool, the downhole isolation tool including:

an outer housing, the outer housing having a fluid passageway extending along a length thereof, an outer housing exterior surface, and an outer housing interior surface;

one or more fluid flow ports connecting the fluid passageway and the outer housing exterior surface;

an isolation sleeve positioned within the fluid passageway, the isolation sleeve configured to shift between an open state allowing fluid flow between the fluid passageway and the outer housing exterior surface, and a closed state covering the one or more fluid flow ports and obstructing fluid flow between the fluid passageway and the outer housing exterior surface; and a sacrificial plug member fluidly coupled with the fluid passageway downhole of the one or more fluid flow ports, the sacrificial plug member configured to seal fluid flow through the fluid passageway; and a lower completion including a tubular string, the downhole isolation tool coupled to a downhole end of the lower completion.

2. The downhole tool as recited in claim 1, wherein the outer housing has an outer housing shoulder along the outer housing interior surface, and the isolation sleeve has an isolation sleeve shoulder along its isolation sleeve exterior surface.

3. The downhole tool as recited in claim 2, further including a biasing spring coupled with the outer housing shoulder and the isolation sleeve shoulder.

4. The downhole tool as recited in claim 3, wherein the biasing spring is configured to bias the isolation sleeve away from the sacrificial plug member.

5. The downhole tool as recited in claim 3, wherein the biasing spring is configured to bias the isolation sleeve toward the sacrificial plug member.

6. The downhole tool as recited in claim 1, further including a retention device coupled between the outer housing and the isolation sleeve, the retention device configured to keep the isolation sleeve in the closed state after having moved from the open state.

7. The downhole tool as recited in claim 6, wherein the retention device is a J-slot/pin retention device.

8. The downhole tool as recited in claim 7, wherein the J-slot/pin retention device includes a J-slot in one of the outer housing or isolation sleeve and a pin in an other of the isolation sleeve or outer housing, and further wherein the J-slot/pin retention device has a run-in-hole slot position configured to keep the isolation sleeve in the open state, an intermediate compressed slot position, and a final compressed slot position configured to keep the isolation sleeve in the closed state after having moved from the open state.

9. The downhole tool as recited in claim 6, wherein the retention device is a snap ring/snap ring grove retention device or body lock ring retention device.

10. The downhole tool as recited in claim 9, wherein the retention device is the snap ring/snap ring groove retention device, and further wherein a snap ring is located in one of the outer housing or isolation sleeve and a snap ring groove in an other of the isolation sleeve or outer housing.

11. The downhole tool as recited in claim 1, further including an uphole end sub coupled to the uphole end of the outer housing and a downhole end sub coupled to the downhole end of the outer housing.

12. The downhole tool as recited in claim 11, wherein the one or more fluid flow ports are one or more uphole fluid flow ports, and further including one or more downhole fluid flow ports.

13. The downhole tool as recited in claim 12, wherein the one or more downhole fluid flow ports are located in the downhole end sub, the one or more downhole fluid flow ports configured to provide fluid flow around the sacrificial plug member when the isolation sleeve is in the open state.

14. The downhole tool as recited in claim 11, wherein the sacrificial plug member is positioned between the downhole end of the outer housing and the downhole end sub.

15. The downhole tool as recited in claim 11, further including a sacrificial plug rupture device located proximate and uphole of the sacrificial plug member, the sacrificial plug rupture device configured to move from an undeployed state leaving the sacrificial plug member intact while the isolation sleeve is in the open state to a deployed state rupturing the sacrificial plug member after the isolation sleeve has moved to the closed state.

16. The downhole tool as recited in claim 15, wherein the sacrificial plug rupture device forms at least a portion of the downhole end sub.

17. The downhole tool as recited in claim 15, wherein the sacrificial plug rupture device includes a shear feature configured to hold it in the undeployed state and a spring member configured to move it to the deployed state.

18. The downhole tool as recited in claim 17, wherein the spring member is a fluid pressure spring configured to move the sacrificial plug rupture device to the deployed state.

19. The downhole tool as recited in claim 1, wherein the sacrificial plug is a glass sacrificial plug.

20. The downhole tool as recited in claim 1, wherein the sacrificial plug is a ceramic sacrificial plug.

21. The downhole tool as recited in claim 1, wherein the downhole tool is coupled directly to the downhole end of the lower completion.

22. A well system, comprising:

a wellbore extending through one or more subterranean formations;

a downhole isolation tool located in the wellbore, the downhole isolation tool including:

an outer housing, the outer housing having a fluid passageway extending along a length thereof, an outer housing exterior surface, and an outer housing interior surface;

one or more fluid flow ports connecting the fluid passageway and the outer housing exterior surface;

an isolation sleeve positioned within the fluid passageway, the isolation sleeve configured to shift between an open state allowing fluid flow between the fluid passageway and the outer housing exterior surface, and a closed state covering the one or more fluid flow ports and obstructing fluid flow between the fluid passageway and the outer housing exterior surface; and a sacrificial plug member fluidly coupled with the fluid passageway downhole of the one or more fluid flow ports, the sacrificial plug member configured to seal fluid flow through the fluid passageway; and a lower completion including a tubular string, the downhole isolation tool coupled to a downhole end of the lower completion.

23. The well system as recited in claim 22, wherein the outer housing has an outer housing shoulder along the outer housing interior surface, and the isolation sleeve has an isolation sleeve shoulder along its isolation sleeve exterior surface.

24. The well system as recited in claim 23, further including a biasing spring coupled with the outer housing shoulder and the isolation sleeve shoulder.

25. The well system as recited in claim 24, wherein the biasing spring is configured to bias the isolation sleeve away from the sacrificial plug member.

26. The well system as recited in claim 24, wherein the biasing spring is configured to bias the isolation sleeve toward the sacrificial plug member.

27. The well system as recited in claim 22, further including a retention device coupled between the outer housing and the isolation sleeve, the retention device configured to keep the isolation sleeve in the closed state after having moved from the open state.

28. The well system as recited in claim 27, wherein the retention device is a J-slot/pin retention device.

29. The well system as recited in claim 28, wherein the J-slot/pin retention device includes a J-slot in one of the outer housing or isolation sleeve and a pin in an other of the isolation sleeve or outer housing, and further wherein the J-slot/pin retention device has a run-in-hole slot position configured to keep the isolation sleeve in the open state, an intermediate compressed slot position, and a final compressed slot position configured to keep the isolation sleeve in the closed state after having moved from the open state.

30. The well system as recited in claim 27, wherein the retention device is a snap ring/snap ring grove retention device or body lock ring retention device.

31. The well system as recited in claim 30, wherein the retention device is the snap ring/snap ring groove retention device, and further wherein a snap ring is located in one of the outer housing or isolation sleeve and a snap ring groove in an other of the isolation sleeve or outer housing.

32. The well system as recited in claim 22, further including an uphole end sub coupled to the uphole end of the outer housing and a downhole end sub coupled to the downhole end of the outer housing.

33. The well system as recited in claim 32, wherein the one or more fluid flow ports are one or more uphole fluid flow ports, and further including one or more downhole fluid flow ports.

34. The well system as recited in claim 33, wherein the one or more downhole fluid flow ports are located in the downhole end sub, the one or more downhole fluid flow ports configured to provide fluid flow around the sacrificial plug member when the isolation sleeve is in the open state.

35. The well system as recited in claim 32, wherein the sacrificial plug member is positioned between the downhole end of the outer housing and the downhole end sub.

36. The well system as recited in claim 32, further including a sacrificial plug rupture device located proximate and uphole of the sacrificial plug member, the sacrificial plug rupture device configured to move from an undeployed state leaving the sacrificial plug member intact while the isolation sleeve is in the open state to a deployed state rupturing the sacrificial plug member after the isolation sleeve has moved to the closed state.

37. The well system as recited in claim 36, wherein the sacrificial plug rupture device forms at least a portion of the downhole end sub.

38. The well system as recited in claim 36, wherein the sacrificial plug rupture device includes a shear feature configured to hold it in the undeployed state and a spring member configured to move it to the deployed state.

39. The well system as recited in claim 38, wherein the spring member is a fluid pressure spring configured to move the sacrificial plug rupture device to the deployed state.

40. The well system as recited in claim 22, wherein the sacrificial plug is a glass sacrificial plug.

41. The well system as recited in claim 22, wherein the sacrificial plug is a ceramic sacrificial plug.

42. The well system as recited in claim 22, further including a whipstock assembly located in the wellbore, the tubular string coupled to a downhole end of the whipstock assembly.

43. The well system as recited in claim 42, wherein the whipstock assembly includes a whipstock element section and an anchoring/sealing subassembly.

44. The well system as recited in claim 42, wherein the anchoring/sealing subassembly includes a sealing section and a latching element section.

45. The well system as recited in claim 22, wherein the downhole tool is coupled directly to the downhole end of the lower completion.

46. A method, comprising:

positioning a downhole isolation tool in a wellbore extending through one or more subterranean formations, the downhole isolation tool including:

an outer housing, the outer housing having a fluid passageway extending along a length thereof, an outer housing exterior surface, and an outer housing interior surface;

one or more fluid flow ports connecting the fluid passageway and the outer housing exterior surface;

an isolation sleeve positioned within the fluid passageway, the isolation sleeve configured to shift between an open state allowing fluid flow between the fluid passageway and the outer housing exterior surface, and a closed state covering the one or more fluid flow ports and obstructing fluid flow between the fluid passageway and the outer housing exterior surface;

a sacrificial plug member fluidly coupled with the fluid passageway downhole of the one or more fluid flow ports, the sacrificial plug member configured to seal fluid flow through the fluid passageway, wherein the downhole isolation tool is coupled along a tubular string of a lower completion, the downhole isolation coupled to a downhole end of the lower completion; and moving the isolation sleeve from the open state allowing fluid flow between the fluid passageway and the outer housing exterior surface to the closed state covering the one or more fluid flow ports and obstructing fluid flow between the fluid passageway and the outer housing exterior surface; and rupturing the sacrificial plug member after moving the isolation sleeve to the closed state.

47. The method as recited in claim 46, wherein the downhole isolation tool further includes a sacrificial plug rupture device located proximate and uphole of the sacrificial plug member, the sacrificial plug rupture device configured to move from an undeployed state leaving the sacrificial plug member intact while the isolation sleeve is in the open state to a deployed state rupturing the sacrificial plug member after the isolation sleeve has moved to the closed state, and wherein rupturing the sacrificial plug member includes rupturing the sacrificial plug member using the sacrificial plug rupture device.

48. The method as recited in claim 46, wherein rupturing the sacrificial plug member includes rupturing the sacrificial plug member using a rupturing conveyance extending from a surface of the wellbore.

49. The method as recited in claim 46, further including:

a whipstock assembly located in the wellbore, the whipstock assembly including a whipstock element section and an anchoring/sealing subassembly, the tubular string coupled to a downhole end of the whipstock assembly.

50. The method as recited in claim 49, wherein the anchoring/sealing subassembly includes a sealing section and a latching element section.

51. The method as recited in claim 50, further including setting the latching element section after moving the isolation sleeve from the open state to the closed state and before rupturing the sacrificial plug member.

52. The method as recited in claim 46, wherein rupturing the plug restores fluid flow and enables subsequent well operations.

53. The method as recited in claim 46, wherein the rupturing the sacrificial plug member after moving the isolation sleeve to the closed state, including rupturing the sacrificial plug member in an interventionless manner.

54. The downhole method as recited in claim 46, wherein the downhole tool is coupled directly to the downhole end of the lower completion.

* * * * *